US011087584B2

(12) United States Patent
Nelson et al.

(10) Patent No.: US 11,087,584 B2
(45) Date of Patent: Aug. 10, 2021

(54) GAMING SYSTEMS AND METHODS FOR ALTERNATING THE PRESENTATION OF LIVE EVENTS

(71) Applicant: IGT, Las Vegas, NV (US)

(72) Inventors: Dwayne Nelson, Las Vegas, NV (US); Kevin Higgins, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/598,439

(22) Filed: Oct. 10, 2019

(65) Prior Publication Data

US 2021/0110632 A1 Apr. 15, 2021

(51) Int. Cl.
*G07F 17/32* (2006.01)

(52) U.S. Cl.
CPC ..... *G07F 17/3211* (2013.01); *G07F 17/3223* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 8,147,334 | B2 | 4/2012 | Gatto et al. | |
| 8,764,566 | B2 | 7/2014 | Miltenberger et al. | |
| 2009/0233705 | A1* | 9/2009 | LeMay | G07F 17/3223 463/25 |
| 2020/0218771 | A1* | 7/2020 | Shah | G06F 16/957 |
| 2020/0267441 | A1* | 8/2020 | Schwartz | H04N 21/4532 |

* cited by examiner

*Primary Examiner* — Ronald Laneau
(74) *Attorney, Agent, or Firm* — Sheridan Ross P.C.

(57) ABSTRACT

The present disclosure relates generally to systems and methods that selectively alter a presentation of a live sporting event rendered to a display device. The presentation of a live sporting event rendered to a portion of the display device is changed from a live video stream, received from a video source, to a non-video alternative presentation of the live sporting event using play-by-play information received from a wagering host server. When a signal of the video source is lost or degraded, the non-video alternative presentation replaces the live video stream with play-by-play information in real time about the live sporting event. The play-by-play information is text about the live sporting event, a two-dimensional graphical representation of the live sporting event, or a three-dimensional graphical representation of the live sporting event.

20 Claims, 10 Drawing Sheets

GAMING SYSTEMS AND METHODS FOR ALTERNATING THE PRESENTATION OF LIVE EVENTS

BACKGROUND

The present disclosure is generally directed to wagering systems and, in particular, toward systems that enable wagering and live event video presentations.

Betting generally includes wagering on a chosen outcome for a particular incident occurring in an event. Based on the odds associated with the outcome of the particular incident, a payout for the wager may be established. The odds are closely tied to the likelihood, or probability, of the outcome occurring. As the likelihood of the outcome occurring increases, the odds and the payout may decrease, and vice versa. In any event, players traditionally wager based on a historical or current state of the event.

The integration of gaming along with the presentation of live event video feeds is growing in popularity among players of modern gaming devices. Because these video feeds are typically delivered to the gaming devices via a traditional distribution sources and methods the quality of a video feed may suffer with any service disruptions, communications failures, or outages associated with the video distribution source.

BRIEF SUMMARY

In certain embodiments, the present disclosure relates to a device, method, and system that provide alternative presentations of events rendered to gaming devices. In some embodiments, a device is provided, comprising: a display device; a communications interface; a processor coupled to the display device and the communications interface; and a memory coupled with and readable by the processor and storing therein instructions that, when executed by the processor, cause the processor to: receive, via the communications interface, video of an event from a video source; receive, via the communications interface, play-by-play information associated with the event from a sports wagering host server; render, in real time, the video of the event to a first portion of a screen of the display device in a first presentation of the event; receive an input to alter the first presentation of the event; cease, in response to receiving the input to alter the first presentation of the event, rendering of the video of the event to the first portion of the screen of the display device; and render, in real time, the play-by-play information associated with the event to a portion of the screen in a second presentation of the event as an alternative to the first presentation of the event.

In some embodiments, a method for providing an alternative presentation of an event on a gaming device is provided, comprising: receiving, via a communications interface of the gaming device, video of the event from a video source; receiving, via the communications interface, play-by-play information associated with the event from a sports wagering host server; rendering, in real time, the video of the event to a first portion of a screen of a display device of the gaming device in a first presentation; receiving an input to alter the first presentation of the event; ceasing, in response to receiving the input to alter the first presentation of the event, the rendering of the video of the event to the first portion of the screen of the display device; and rendering, in real time, the play-by-play information associated with the event to a portion of the screen in a second presentation in lieu of the video.

In some embodiments, a system for providing alternative presentations of an event for display is provided, comprising: a server, comprising: a communications interface; a processor coupled to the communications interface; and a memory coupled with and readable by the processor and storing therein instructions that, when executed by the processor, cause the processor to: receive, via the communications interface, video of the event from a video management server; receive, via the communications interface, play-by-play information associated with the event from a sports wagering host server; send a first rendering command that causes the video of the event to be rendered, in real time, to a first portion of a screen of a display device in a first presentation of the event; receive an input to alter the first presentation of the event; send a cease-rendering command, in response to receiving the input to alter the first presentation of the event, that causes the video of the event to cease rendering to the first portion of the screen of the display device; and send a second rendering command that causes the play-by-play information associated with the event to be rendered, in real time, to a portion of the screen in a second presentation of the event as an alternative to the first presentation of the event.

Additional features and advantages are described herein and will be apparent from the following Description and the figures.

DETAILED DESCRIPTION

Figure 1A:
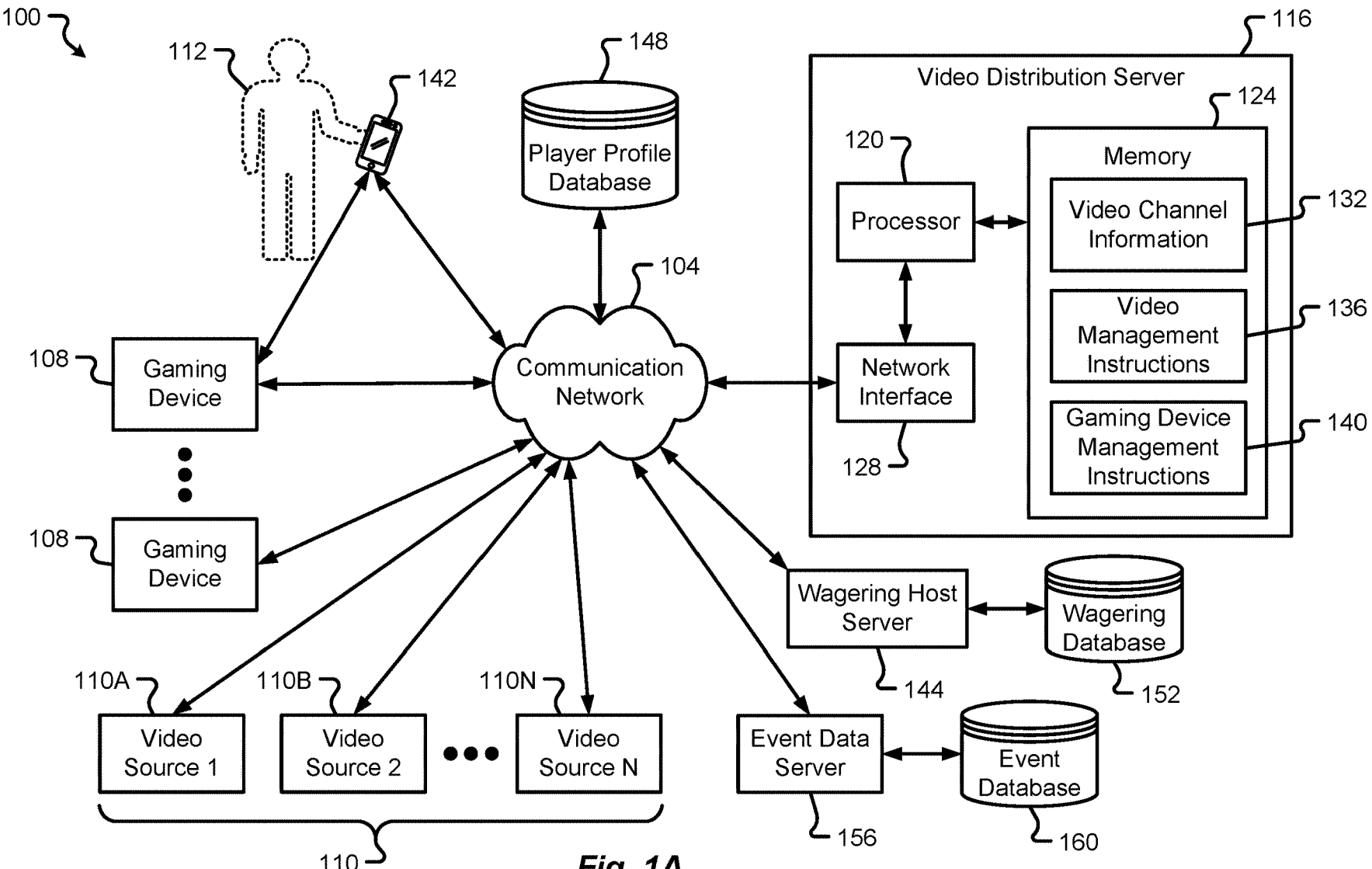
FIG. 1A is a block diagram of an event wagering and presentation system in accordance with embodiments of the present disclosure.

Embodiments of the present disclosure will be described in connection with an event wagering and presentation system having one or multiple gaming devices that render information about events in various display presentations. The gaming devices may comprise any computing device, personal gaming device, mobile phone, mobile devices, Electronic Gaming Machine (EGM), sports wagering terminal, or collection of computing devices that receive and render information about events in a specific display presentation based on a number of criteria.

Embodiments of the present disclosure may provide the ability for users (e.g., players) to wager on particular outcomes associated with an event (e.g., sports wagering, etc.) and view live video streams of the event via the gaming device. Occasionally, video streams may fail, or otherwise degrade, for various reasons including, but not limited to, network problems, hardware encoding problems, and/or satellite interference to name a few. It is an aspect of the present disclosure to change the presentation of the live event rendered to the gaming device upon detecting a failure or degradation in one or more live video streams. This change to the presentation allows the user of the gaming device to continue making wagers while still receiving information about the event, albeit in a different presentation. Rather than terminate a functionality of the gaming device, the alternative presentation of the event allows the gaming device to continue to operate providing a seamless user experience and facilitating wagering without interruption.

In one embodiment, the gaming device may show a description of each play as the alternative presentation rather than show the live video. This alternative presentation may be referred to herein as a "play-by-play" presentation or data-based presentation. Embodiments of the present disclosure allow a user to continue wagering and receive information about an event, even when a particular presentation of the event is not available, maximizing the value of the gaming device. In some embodiments, the gaming device may use an alternative stream for the live video presentation to maintain a video quality and presentation seen by the user at the gaming device.

In some embodiments, the gaming device may learn about sports wagering from a wagering host server (e.g., a sports wager host, etc.). This host server may manage the odds, wagers and payments associated with various events or particular outcomes in the event. The gaming device may be operatively connected to a video distribution server that provides the gaming device with live video. This connection may include providing video in a format encoded in the H.264 advanced video coding standard. The H.264 encoded video may be provided to the gaming device over TCP/IP or UDP. Additionally or alternatively, the gaming device may use a hardware video mixing device to render images onto the screen of the gaming device.

The gaming device may learn channel information from a video distribution server, which may be a separate device or part of another component of the event wagering and presentation system. In some embodiments, video channel information may be received from a video channel information server and stored in a memory of the video distribution server. In any event, the video distribution server may inform the gaming device which TCP/IP address, or UDP address, should be used for each channel. For example, the video distribution server may inform the gaming device that a first channel (e.g., ESPN) is on a first uniform resource locator (URL), or address, such as "123.56.62.6:22."

An encoder may be used to encode video received from one or more video sources. The channel information may include an identification of the provider of a particular video source in the one or more video sources. Examples of providers may include, but are in no way limited to, a multiple service operator (MSO), a cable company (e.g., Cox® Cable, etc.), a satellite company (e.g., DirecTV®), online streaming service company, etc., and/or combinations thereof. In some embodiments, the channel information may include the format of the video provided from one or more video sources. For instance, it is possible that video of the same sporting event is available on different URLs in the event wagering and presentation system. In some cases, the video (e.g., of same sporting event) available on the different URLs may vary by quality and/or by provider. For example, one provider may charge less, or more, to a casino for use of a particular video stream than another provider. Additionally or alternatively, one provider may play more commercials, or even just different types of commercials, during the video stream than another provider that is offering a video stream for the same sporting event.

In some embodiments, a provider (e.g., DirecTV®, etc.) may provide a set-top box that directly outputs, for example, H.264 encoded video. In this example, an external encoder would not be necessary as part of the event wagering and presentation system. Stated another way, the encoder may be part of (e.g., located within) the DirecTV set-top box such that the output of the set-top box is Ethernet. One example of a product that includes an encoder and provides video over Ethernet is the DirecTV® COM2000 head end system.

In some embodiments, the gaming device may be able to match a live video feed of an event to a matching wagering opportunity for the event on the wagering host server, or vice versa. In one embodiment, the video distribution server may match a live video feed of an event to a matching wagering opportunity for the event on the wagering host server, or vice versa.

Video streams may be defined by various parameters that affect how they appear or will be rendered by a display device (e.g., of the gaming device, etc.). The parameters of each video stream may comprise at least one of resolution (e.g., 1024 pixels by 768 pixels, etc.), frame rate (e.g., 30 frames per second, 60 frames per second, etc.), encoding format (e.g., H.264 advanced video coding, H.265 high efficiency video coding, VP9 coding format, etc.), color space (e.g., sRGB, etc.), sound encoding, quality, and the like. In some embodiments, the parameters may include, but are in no way limited to, video encoding parameters such as key frame frequency and how to handle errors or retries, etc.

In one embodiment, the gaming device may detect that a live video stream of an event is not functioning or is not producing a predetermined and required level of video quality. The gaming device may proceed to switch the live video to a more static alternative display presentation. The gaming device is still receiving information from the wagering host server (e.g., a sports wagering host, etc.) that provides real-time or play-by-play data for the event. The gaming device can illustrate and render this information via the display device of the gaming device using text and graphics (e.g., a visualization and presentation other than live video). The graphics may include logos of a team and/or pictures, or other representative icons, of an element of the game, such a ball, a field, a player etc. For example, the alternative display presentation may render the text "The Patriots make a first down. It's now first down on the 43rd yard line," describing a current play, a particular outcome, and/or a state of the event, as the event is played live. This alternative display presentation still allows a user to continue making wagers on particular outcomes of the event without the live video. In one embodiment, the alternative display presentation may be a two-dimensional (2D) or three-dimensional (3D) simulation, or representation, of the live sports event which is generated based on the information received from the wagering host server (e.g., the sports wagering host, etc.). This alternative display presentation may be animated providing transitions between plays, color changes for positive or negative outcomes (e.g., to the user who may have wagered on the event, etc.), enhanced sounds indicating a state of the event, and/or the like.

It is an aspect of the present disclosure that a user of the gaming device may choose to switch between the live video and the more static alternative display presentation. The user may make an input at a user interface (e.g., touchscreen, keyboard, mouse, etc.) of the gaming device to switch between various types of presentations of the event. In some embodiments, the event wagering and presentation system may store the selection made by the user and/or preferences selected by the user in a memory location associated with the user.

In some embodiments, the event wagering and presentation system may automatically detect that the live video of an event is not functioning or not functioning to an acceptable level and automatically switch to another source for live video of the event. For example, the gaming device may be connected to a live video streaming system provided by DirecTV®, on channel 22, to watch an NFL game. The video stream in this example may be expected to be 30 frames per second and have an error rate of less than 1%. If the gaming device detects a higher error rate than expected, a lower frame rate than expected, network problems, or any other parameters impacting the video (e.g., based on stored predetermined quality threshold values, etc.), the gaming device and/or some other component of the event wagering and presentation system can switch to another channel. In this example, the gaming device may switch to a local channel (e.g., CBS channel 3) for live video of the same NFL game. The gaming device may have originally selected the first (DirecTV®) stream because the video source had better parameters than other video sources for the NFL game at the time of selection. However, in response to detecting change in parameters, the gaming device may determine that the local CBS version of the NFL game video, although having worse video parameters (e.g., lower resolution, limited performance, etc.) than the first stream at the time of selection, is better than the current parameters of the first stream and determine that the local CBS version of the NFL game video is acceptable.

The gaming device may render multiple windows via the display device with, potentially, multiple live video events. The user of the gaming device may enlarge a window to focus on a particular live video game stream. In one embodiment, the event wagering and presentation system may encode one or more source channels to different streams of different quality. For example, the event wagering and presentation system may stream the Cowboys game at two different resolutions such as 400 by 300 pixels and also 4K resolution. The gaming device may select the URL to use based on the current configuration (e.g., size, position, etc.) of the windows rendered via the display device of the gaming device. In one embodiment, a mobile gaming device (e.g., smartphone, etc.) may determine to use one stream while the gaming device may use another stream because the two devices differ greatly in screen size and, as such, may use very different resolutions.

In one embodiment the gaming device or other component of the event wagering and presentation system may detect that the video quality associated with a video stream is poor and may issue a command to one or more encoders of the event wagering and presentation system to change the parameters of the video stream. For example, the gaming device may send a command to the encoder instructing the encoder to change from 60 frames per second to 30 frames per second for the video stream to lower the network bandwidth. In one embodiment, the gaming device sends the command in response to a user input (e.g., received at the user interface of the gaming device, etc.). For example, a user may wish to view the video smaller or larger so command may instruct that the encoder output the video stream at a different resolution. In one embodiment, the gaming device may report one or more video quality statistics to the encoder or a server (e.g., the video distribution server) controlling the encoder, and the server may adjust the parameters of the encoder if the reported video quality degrades below one or more predetermined and stored thresholds.

In one embodiment, the user of a gaming device can change the quality settings of a video stream such as the frame rate, resolution, etc. In one embodiment, only certain types of users may be authorized to perform this change operation. For instance, a user may be associated with a player rank such as "gold" or "platinum" level players of a loyalty system or only users who have wagered a certain amount of money. In this manner, users may be rewarded by the owner of the event wagering and presentation system (e.g., a casino, operator, etc.) with higher quality video experiences and/or certain levels of customizability.

In one embodiment, the quality parameters of a video stream of an event or a type of the alternative view of the event may depend on whether the user of the gaming device is currently wagering on the event. For example, the user may initially be presented with a text view of the event via the display device of the gaming device and the user may place a wager on the event (e.g., via the gaming device). Upon confirming that the wager was placed by the user, the gaming device may switch the text view of the event to a live video of the event (e.g., because the user is now wagering on the event) rendering live video to the display device. This method may similarly apply to switching the resolution and/or other quality parameters associated with live video. In this manner, the gaming device may encourage a user to wager on events and become more engaged in the experience (e.g., by being rewarded with better viewing presentations) as opposed to simply watching low-resolution live sporting events at the gaming device. In some embodiments, this method may allow an owner to determine and manage payments associated with the licensing costs of redistributing a live sporting event video feed to customers (e.g., users) who routinely place sports wagers and limit, restrict, or deny the presentation of a live sporting event video to customers (e.g., online/mobile players, etc.) who never place a significant size or sum of wagers on an event.

In some embodiments, the gaming devices described herein may allow wagering and the presentation of event information and provide traditional casino and/or interactive gaming such as video poker, slots, bingo, blackjack, skill games, electronic table games (e.g., live roulette, baccarat, etc.), and keno. The gaming device may be configured to allow a user to place wagers on particular outcomes of an event via the gaming device. The events described herein may include, but are in no way limited to, live sporting events, live horse racing events, live competitive contests, shows, and/or other events having one or more particular outcomes or chances for the one or more particular outcomes to occur.

With reference initially to FIG. 1, details of an illustrative event wagering and presentation system 100 will be described in accordance with at least some embodiments of the present disclosure. The components of the event wagering and presentation system 100, while depicted as having particular instruction sets and devices, are not necessarily limited to the examples depicted herein. Rather, a system according to embodiments of the present disclosure may include one, some, or all of the components depicted in the system 100 and does not necessarily have to include all of the components in a single device. For instance, the components of a server may be distributed amongst a plurality of servers and/or other devices (e.g., gaming devices, EGMs, mobile devices, etc.) in the system 100 without departing from the scope of the present disclosure.

The event wagering and presentation system 100 is shown to include a communication network 104 that interconnects and facilitates machine-to-machine communications between one or multiple gaming devices 108, video sources 110, a video distribution server 116, a wagering host server 144, and an event data server 156. In some embodiments, the event data server 156 may be connected to the wagering host server 144 directly and the gaming devices 108 may receive event data via the wagering host server 144. It should be appreciated that the communication network 104 may correspond to one or many communication networks without departing from the scope of the present disclosure. In some embodiments, the gaming devices 108 and server(s) 116, 144, 156 may be configured to communicate using various nodes or components of the communication network 104. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the gaming devices 108 may be distributed throughout a single property or premises (e.g., a single casino floor) or the gaming devices 108 may be distributed among a plurality of different properties. In a situation where the gaming devices 108 are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming devices 108 may utilize the same or different types of communication protocols to connect with the communication network 104. It should also be appreciated that the gaming devices 108 may or may not present the same type of wagering interface, game, video presentation of an event, or alternative presentation of an event to a user 112 (e.g., a player). For instance, a first gaming device 108 may correspond to a gaming machine that presents a slot game to the user 112, the second gaming device 108 may correspond to a sports wagering terminal, and other gaming devices 108 may present other types of games or a plurality of different games for selection and eventual play by a user 112. It may be possible for the some of the gaming devices 108 to communicate with one another via the communication network 104. In some embodiments, one or more of the gaming devices 108 may only be configured to communicate with a centralized management server and/or the video distribution server 116. Although not depicted, the system 100 may include a separate server (e.g., a gaming server, etc.) or collection of servers that are responsible for managing the operation of the various gaming devices 108 in the event wagering and presentation system 100. It should also be appreciated that the video distribution server 116 may or may not be co-located with one or more gaming devices 108 in the same property or premises. Thus, one or more gaming devices 108 may communicate with the video distribution server 116 over a WAN, such as the Internet. In such an event, a tunneling protocol or Virtual Private Network (VPN) may be established over some of the communication network 104 to ensure that communications between a gaming device and a remotely-located server 116 are secured.

A gaming device 108 may correspond to a type of device that enables user interaction in connection with making wagers, watching events such as live competitive contests, and/or playing games of chance. For instance, the gaming devices 108 may correspond to a type of device that enables a user 112 to wager on, and watch, events via a display device of the gaming device 108. A gaming device 108 may include any type of known gaming device such as a slot machine, a table game, an electronic table game (e.g., video poker), a skill-based game, etc. The gaming device 108 can be in the form of an EGM, virtual gaming machine, video game gambling machine, etc. One particular type of gaming device 108 may include mobile devices 142 such as portable communications devices, personal computers, and/or other microprocessor-enabled devices having memory and communications interfaces. Non-limiting examples of a mobile device 142 include a cellular phone, a smartphone, a tablet, a wearable device, an augmented reality headset, a virtual reality headset, a laptop, a Personal Computer (PC), or the like. In addition to playing games and wagering on a gaming device 108, the users 112 may also be allowed to watch live sporting events on a respective mobile device 142. In some embodiments, the mobile device 142 may interact with a particular gaming device 108 to allow a user 112 to play games on one device while watching videos on another device. The mobile device 142 may run an application that, among other things, enables the event wagering and presentations described herein. As provided above, the mobile device 142 may correspond to a user's 112 personal device (e.g., a smartphone) or to a device that is issued to the user 112 during the user's visit to a particular casino. It should be appreciated that the user 112 may play games directly on their mobile device 142 and/or the mobile device 142 may be in communication with another gaming device 108 such that the mobile device 142 provides the human-to-machine interface for the user 112 to the other gaming device 108. As shown in FIG. 1, the mobile device 142 may be in communication with the communication network 104 or in direct communication (e.g., via Bluetooth, WiFi, etc.) with another gaming device 108 in the event wagering and presentation system 100.

The event wagering and presentation system 100 may include one or more video sources 110A-N. Each of the video sources 110A-N may correspond to a source of a video stream (e.g., live video stream) for an event (e.g., a live sporting event, etc.) including but in no way limited to a provider, a channel number, an address, etc. In some embodiments, at least one of the video sources 110A-N may comprise a video server comprising a processor 120, memory 124, and a network interface 128, similar, if not identical, to those described in conjunction with the components of the event wagering and presentation system 100 below. The video server may be configured to host and provide live video of one or more events bet on by users 112 of a gaming device 108 in the event wagering and presentation system 100. In some embodiments, the video server may be interconnected with the communication network 104 and may provide video or other live streaming content via a real-time streaming protocol (RTSP), data over cable service interface specification (DOCSIS), or other communications protocol. The video server may be hosted and/or operated by an MSO, a satellite television company, an Internet entertainment company, or some other online video streaming service company. In any event, embodiments of the present disclosure describe receiving video, live streams or feeds, and/or other content from the video server associated with one or more video sources 110A-N and rendering such information, at least in part, to the one or more gaming devices 108 and/or some other display device.

The video distribution server 116 is further shown to include a processor 120, memory 124, and a network interface 128. These resources may enable functionality of the video distribution server 116 as will be described herein. For instance, the network interface 128 provides the server 116 with the ability to send and receive communication packets or the like over the communication network 104. The network interface 128 may be provided as a network interface card (NIC), a Slot Machine Interface Board (SMIB), a network port, a modem, drivers for the same, and the like. Communications between the components of the server 116 and other devices connected to the communication network 104 may all flow through the network interface 128.

The processor 120 may correspond to one or many computer processing devices. For instance, the processor 120 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 120 may be provided as a microprocessor, Central Processing Unit (CPU), or plurality of microprocessors that are configured to execute the instructions sets stored in memory 124. Upon executing the instruction sets stored in memory 124, the processor 120 enables various video management, player authentication, and gaming device management functions of the video distribution server 116.

The memory 124 may include any type of computer memory device or collection of computer memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions. Although not depicted, the memory 124 may include instructions that enable the processor 120 to store data into a player profile database 148 and/or a wagering database 152 and retrieve information from the databases 148, 152. Alternatively or additionally, the player profile database 148 or data stored therein may be stored internal to the server 116 (e.g., within the memory 124 of the server 116 rather than in a separate database). Alternatively or additionally, the wagering database 152 or data stored therein may be stored internal to the video distribution server 116 or the wagering host server 144.

The memory 124 may store various data and instruction sets that allow the video distribution server 116 to provide video to one or more gaming devices 108. Examples of data may include, but are in no way limited to, video channel information 132. The video channel information 132 may identify a particular video source 110A-N (e.g., a provider, a channel number, an address, etc.) for a video stream of each event available to the video distribution server 116 from one or more video sources 110A-N. Additionally or alternatively, the video channel information 132 may comprise information about the video stream parameters associated with each video stream, such as, resolution, frame rate, encoding format, color space, sound encoding, quality, key frame frequency, how to handle errors or retries, etc.

Illustrative instruction sets that may be stored in memory 124 include, without limitation, a video management instruction set 136 and a gaming device management instruction set 140. Functions of the server 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the server 116. Said another way, the particular instruction sets depicted in FIG. 1 should not be construed as limiting embodiments described herein.

The video management instruction set 136, when executed by the processor 120, may enable the video distribution server 116 to determine at least one of the event presentations, encoding of video streams, selection of video streams, changing of video sources providing a particular type of video stream, and the distribution of video streams for rendering via the display device of one or more gaming devices 108. The video management instruction set 136 may determine video sources 110A-N that are capable of providing video (e.g., a live video stream, etc.) of events in the wagering host server 144. Alternatively, the video management instruction set 136 may determine events in the wagering host server 144 and match the events to corresponding live video streams of the events provided by the respective video sources 110A-N. In some embodiments, a video management application 234 running on the video distribution server 116 and/or the gaming device 108 (e.g., a mobile device 142, etc.) may enable the event presentations, encoding, selection of video streams, changing of video sources, distribution of video streams, and matching of video sources providing the video of events to events in the wagering host server 144 (e.g., events having wagering opportunities, etc.). In other words, any distribution and/or matching of event videos associated with an event presentation rendered via the gaming devices 108 may be managed, partially or entirely, by execution of the video management instruction set 136.

The gaming device management instruction set 140, when executed by the processor 120, may control one or more features of the gaming devices 108 based on video parameters and/or in response to input provided by a user 112 at the gaming device 108. In some embodiments, these instructions and control may be made on the gaming device 108. Stated another way, the control of the one or more features of the gaming devices 108 does not necessarily have to be communicated to the video distribution server 116 or the gaming device management instruction set 140 running on the video distribution server 116. In some embodiments, the gaming device management instruction set 140 may also be configured to track a status of wagers made by a user 112. For instance, the gaming device management instruction set 140 may determine whether a user of a specific gaming device 108 has placed a wager on an event or on a particular outcome of the event. In some embodiments, when a wager has come to completion such that the wager made on a particular outcome of the event becomes payable (e.g., at the end of a sporting event when the final score of the event is determined, when an outcome of an incident in the event is determined to have occurred, or not occurred, in a given time, etc.), the gaming device management instruction set 140 may notify the video management instruction set 136, thereby enabling the gaming device 108 of a user 112 to render a particular presentation of the event provided by the video distribution server 116.

The gaming device management instruction set 140 may enable the video distribution server 116 to manage one or more data fields for a player profile associated with a user 112, for example, stored in the player profile database 148. In some embodiments, the gaming device management instruction set 140 may cause a gaming device 108 to update an appropriate credit meter for the user 112 within the gaming device 108 used by the user 112. In some embodiments, the video distribution server 116 may be configured to create one or more player profiles and associated data structures within the player profile database 148. A player profile, in some embodiments, may include user 112 identification information and a wager account record for the player. In some embodiments, the gaming device management instruction set 140 may be responsible for managing or updating electronic records of all users 112 within the event wagering and presentation system 100 or a subset of users 112 within the event wagering and presentation system 100.

The event wagering and presentation system 100 may comprise a wagering host server 144 that determines wagering options and events, sets odds, and accepts bets made by users 112 at one or more gaming devices 108. The wagering host server 144 may be an online sportsbook and/or racebook that is accessible across the communication network 104. Similar to the video distribution server 116, the wagering host server 144 may comprise a processor 120, memory 124, and a network interface 128, as described above. In some embodiments, the memory 124 of the wagering host server 144 may comprise different instructions than the memory 124 of the video distribution server 116. Upon receiving a wager on a particular outcome of an incident in an event (e.g., placed by a user 112 at a gaming device 108), the wagering host server 144 may store the bet in the wagering database 152. As provided above the events may include, but are in no way limited to, matches, games, races (e.g., horse races, dog races, political races, etc.), competitions, boxing events, fighting events (e.g., boxing, mixed martial arts (MMA), wrestling, judo, karate, etc.), entertainment events, organized events, shows, combinations thereof, and/or discrete wagering opportunities on incidents associated with the same. In some embodiments, the wagering host server 144 may receive information from one or more gaming devices 108 regarding wagers made on events. This information may define a wager description, a particular outcome, a bet amount, and/or timing associated with the wager.

The event data server 156 may correspond to a server that tracks and records incidents or occurrences associated with events. These incidents may include, but are in no way limited to, scores, positions, plays, penalties, errors, injuries, calls, reviews, outcomes, results, times associated therewith, and/or the like. In some embodiments, these incidents may be automatically determined, via a processor, recognizing the occurrence of an incident during an event. In one embodiment, these incidents may be manually recorded by one or more individuals recording information about an event and manually entering the information into one or more fields provided by an application run on, or hosted by, the event data server 156. Examples of typical incidents associated with an event, like American football for instance, may include instances or occurrences such as fumbles, pass completions, incomplete passes, interceptions, punts, downs made, yards gained, timeouts taken, field goals, safeties, extra points, and touchdowns, to name a few. These incidents may be cataloged, associated with a particular team and/or game, and stored along with a time of the incident in a memory device such as event database 160. Similar to the video distribution server 116, the event data server 156 may comprise a processor 120, memory 124, and a network interface 128, as described above. In one embodiment, the event data server 156 may be connected to, or be part of, the wagering host 144.

Figure 1B:
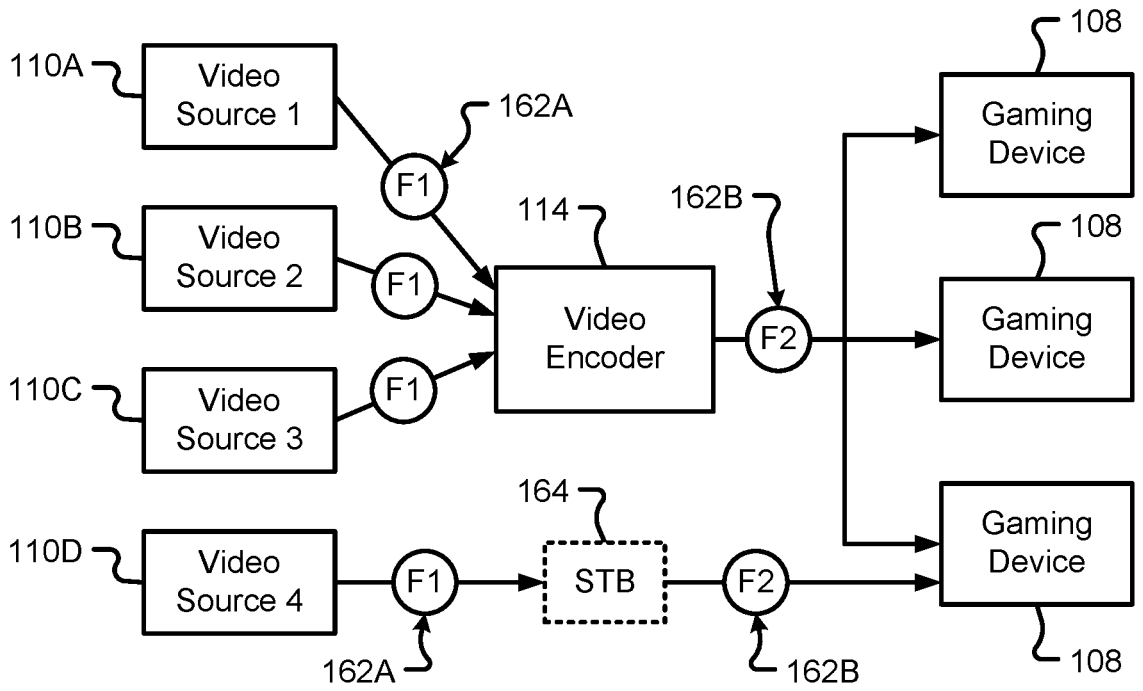
FIG. 1B is a block diagram of a first encoding arrangement of the event wagering and presentation system in accordance with embodiments of the present disclosure.

FIG. 1B is a block diagram of a first encoding arrangement of the event wagering and presentation system 100 in accordance with embodiments of the present disclosure. In some embodiments, the video distribution server 116 may comprise a video encoder 114. The video encoder 114 may be configured to convert a first format 162A of a video stream into a second format 162B of the video stream. In some embodiments, the video encoder 114 may be part of a set-top box 164 or other head end system. In any event, video streams may be provided from the plurality of video sources 110A-D in a first format 162A before being converted into the second format 162B provided to the gaming devices 108 in the event wagering and presentation system 100. In some embodiments, the video encoder 114 or the set-top box 164 may be a picture-in-picture device that combines video from the gaming device 108 with a video source 110A-D (e.g., the fourth video source 110D, etc.) into a single video stream displayed on the screen of the gaming device 108. In this configuration, the gaming device 108 instructs the video system (e.g., the video encoder 114, the set-top box 164, and/or the fourth video source 110D) to change channel, change resolution, or change video quality. In some embodiments, rather than switching between URLs for video, the event wagering and presentation system 100 may switch to/from the picture-in-picture device or make changes to the picture in picture device (e.g., quality, resolution, etc.).

As shown in FIG. 1B, the first video source 110A, second video source 110B, and third video source 110C are providing respective video streams to the video encoder 114 in the first format 162A. In some embodiments, the first format 162A may correspond to a high-definition multimedia interface (HDMI) video standard format. The video encoder 114 may include one or more inputs (e.g., HDMI inputs, etc.), encoding equipment that converts the first format 162A of video stream (e.g., HDMI) into the second format 162B of video stream (e.g., H.264), and one or more outputs (e.g., Ethernet, etc.) to distribute the second format 162B of the video stream to one or more gaming devices 108.

The fourth video source 110D is shown providing a video stream to the set-top box 164 in the first format 162A. Similar to the external video encoder 114, the set-top box 164 may include an encoder that converts the first format 162A of the video stream into the second format 162B of the video stream, which can then be distributed to the gaming devices 108. As provided above, the second format 162B of the video stream may correspond to an H.264 video stream output provided, for example, over Ethernet or WiFi to one or more of the gaming devices 108.

Figure 1C:
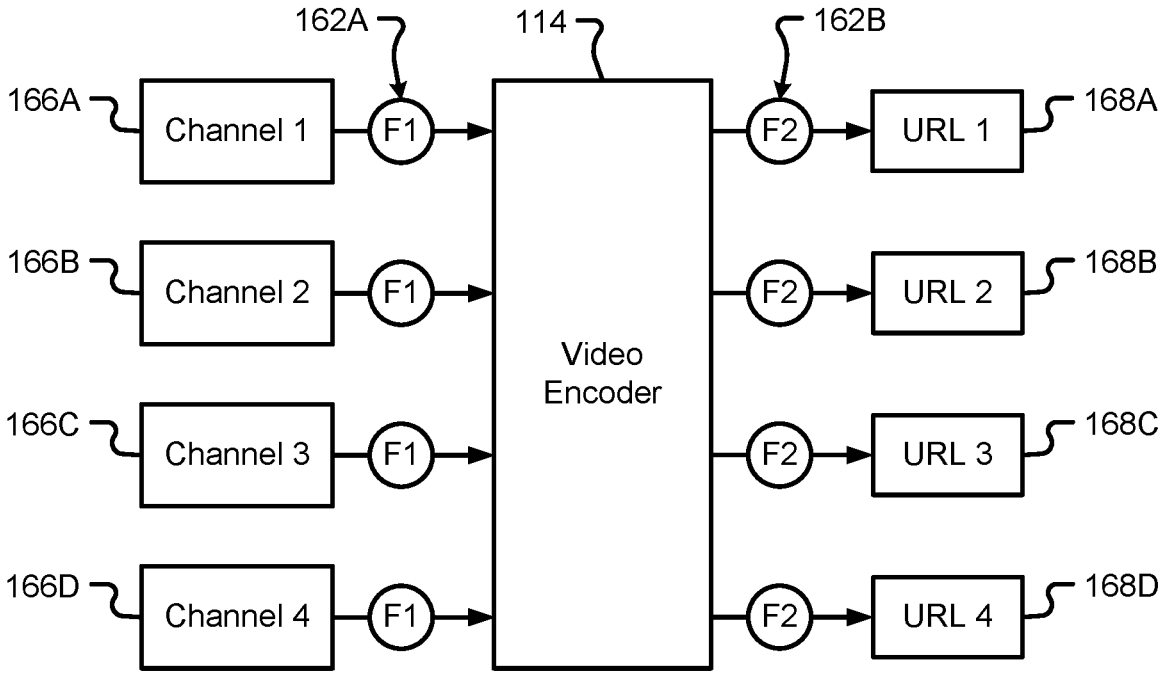
FIG. 1C is a block diagram of a second encoding arrangement of the event wagering and presentation system in accordance with embodiments of the present disclosure.

FIG. 1C is a block diagram of a second encoding arrangement of the event wagering and presentation system 100 in accordance with embodiments of the present disclosure. In FIG. 1C, each video stream provided to the video encoder 114 may be associated with a particular channel number 166A-D. The channel numbers 166A-D may correspond to individual channels of at least one of an MSO, cable company, satellite company, and/or other online streaming video service company. Examples of channels may include, but are in no way limited to, an ESPN sports channel, a local CBS channel, a paid-for channel, a subscription channel, some other network channel, and/or the like. Each channel 166A-D may provide a video stream to the video encoder 114 in a first format 162A. The video encoder 114 may convert the first format 162A of the video stream into the second format 162B of the video stream and assign each channel output to a unique URL 168A-D. As described above, the first format 162A may correspond to an HDMI video stream and the second format 162B may correspond to an H.264 video stream. In one embodiment, the first URL 168A may correspond to an address, such as video/channel/1, for the first channel 166A. The second URL 168B may correspond to an address, such as video/channel/2, for the second channel 166B. The third URL 168C may correspond to an address, such as video/channel/3, for the third channel 166C. The fourth URL 168D may correspond to an address, such as video/channel/4, for the fourth channel 166D. Although described as an URL that defines a location of each channel 166A-D in the event wagering and presentation system 100, the URLs 168A-D may correspond to unique IP addresses for each channel 166A-D in the event wagering and presentation system 100. In any event, the unique URLs 168A-D created for each channel 166A-D (e.g., by the video encoder 114) may be used by the video distribution server 116 in distributing video to the gaming devices 108 in accordance with embodiments of the present disclosure.

Figure 2:
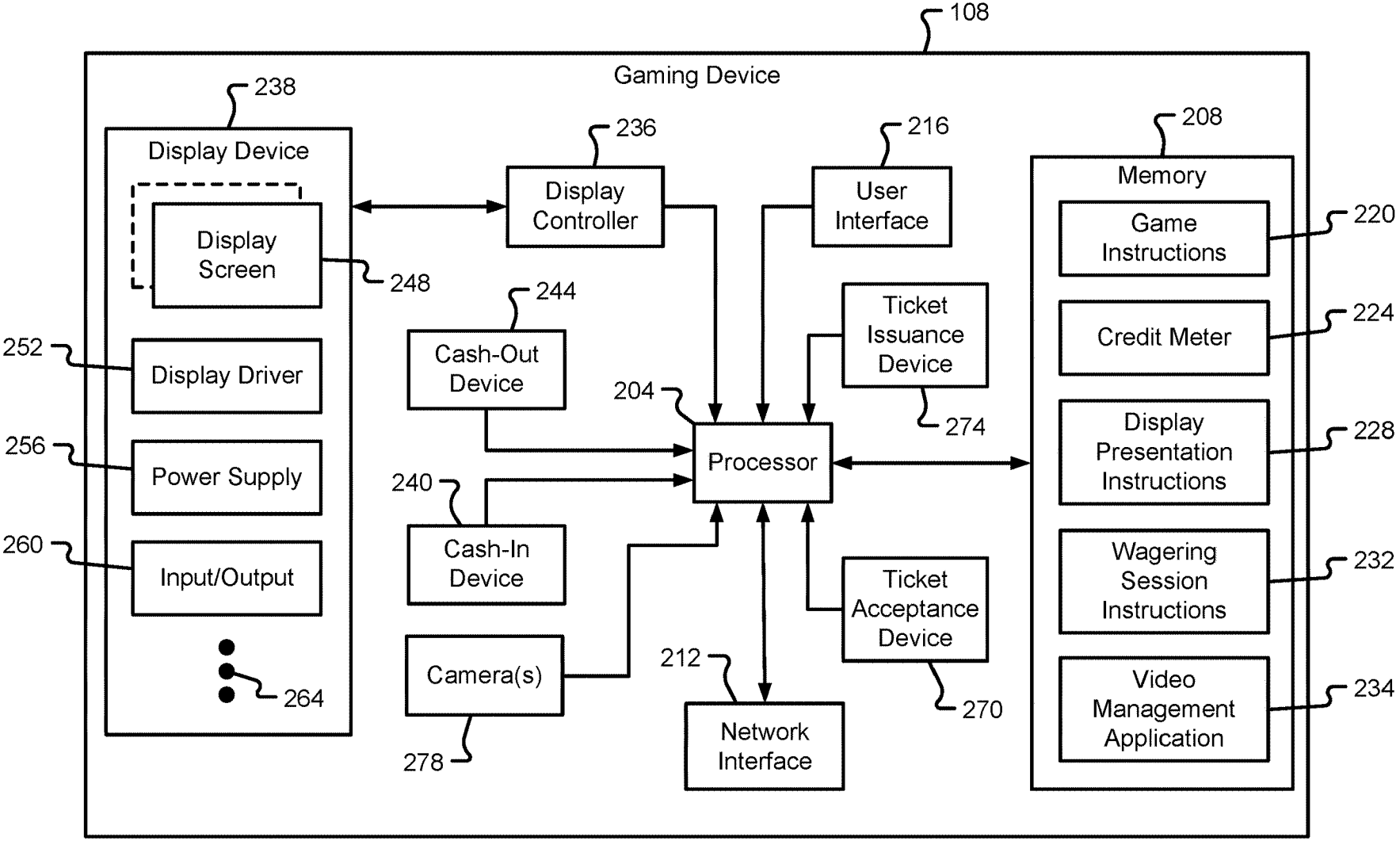
FIG. 2 is a block diagram depicting an illustrative gaming device in accordance with embodiments of the present disclosure.

With reference now to FIG. 2, additional details of a gaming device 108 will be described in accordance with at least some embodiments of the present disclosure. While depicted as a gaming device 108, it should be appreciated that some or all of the components of a single gaming device 108 may be distributed across multiple gaming devices 108 (of the same or different type) without departing from the scope of the present disclosure.

The gaming device 108 is depicted to include a processor 204, memory 208, a network interface 212, a user interface 216, a display controller 236, a display device 238, a cash-in device 240, a cash-out device 244, a ticket acceptance device 270, a ticket issuance device 274, and one or more cameras 278. In some embodiments, the processor 204 may be similar or identical to the processor 120. In other words, the processor 204 may correspond to one or many microprocessors, CPUs, microcontrollers, or the like. The processor 204 may be configured to execute one or more instruction sets stored in memory 208.

The network interface 212 may also be similar or identical to network interface 128. The nature of the network interface 212, however, may depend upon whether the network interface 212 is provided in a gaming device 108 or a mobile device 142. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the gaming device 108 is connecting to a single communication network 104 or multiple different types of communication networks 104. For instance, the gaming device 108 may be provided with both a wired network interface and a wireless network interface without departing from the scope of the present disclosure. In some embodiments, the network interface 212 may include different communications ports that interconnect with various input/output lines. For example, a first communications port may provide an interconnection (e.g., via at least one Ethernet, RJ-11, RJ-45, or other communications port) between the network interface 212 and the video distribution server 116, or other servers 144, 156 in the event wagering and presentation system 100. Continuing this example, a second communications port of the network interface 212 may provide an interconnection between the network interface 212 and the video distribution server 116. In this manner, the gaming device 108 may allow for the transfer of information from one or more of the servers 116, 144, 156 in the event wagering and presentation system 100, while simultaneously receiving at least one video feed from the video distribution server 116 and/or the one or more video sources 110A-N.

The user interface 216 may correspond to any type of input and/or output device that enables the user 112 to interact with the gaming device 108. As can be appreciated, the nature of the user interface 216 may depend upon the nature of the gaming device 108. For instance, if the gaming device 108 includes a slot machine game, then the user interface 216 may include one or more reels, or virtual rendered reels, with symbols provided thereon, one or more lights or LED displays, one or more depressible buttons, a lever or "one armed bandit handle," a speaker, or combinations thereof. If the gaming device 108 is a digital or mobile device 142, then the user interface 216 may include one or more touch-sensitive displays, LED/LCD display screens, buttons, switches, etc.

The memory 208 may be similar or identical to memory 124. For instance, the memory 208 may include one or multiple computer memory devices that are volatile or non-volatile. The memory 208 may be configured to store instruction sets that enable user 112 interaction with the gaming device 108, that enable game play at the gaming device 108, that enable viewing of event presentations at the gaming device 108, that enable coordination with the video distribution server 116. Examples of instruction sets that may be stored in the memory 208 include a game instruction set 220, a credit meter 224, a display presentation instruction set 228, a wagering session instruction set 232, and/or other instruction sets.

In some embodiments, the game instructions 220, when executed by the processor 204, may enable the gaming device 108 to facilitate one or more games of chance or skill and produce interactions between the user 112 and the game of chance or skill. In some embodiments, the game instructions 220 may include subroutines that present one or more graphics to the user 112 via the user interface 216, subroutines that calculate whether a particular game wager has resulted in a win or loss during the game of chance or skill, subroutines for determining payouts for the user 112 in the event of a win, subroutines for exchanging communications with a connected server (e.g., game management server, video distribution server 116, or the like), subroutines for enabling the user 112 to engage in a game using their mobile device 142, and any other subroutine or set of instructions that facilitate gameplay at or in association with the gaming device 108.

The credit meter 224 may correspond to a data structure within the gaming device 108 that facilitates a tracking of activity at the gaming device 108. In some embodiments, the credit meter 224 may be used to store or log information related to various user 112 activities and events that occur at the gaming device 108. The types of information that may be maintained in the credit meter 224 include, without limitation, player information, available credit information, wager amount information, and other types of information that may or may not need to be recorded for purposes of accounting for wagers placed at the gaming device 108 and payouts made for a user 112 during a game of chance or skill played at the gaming device 108. In some embodiments, the credit meter 224 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming device 108, and the like. In some embodiments, certain portions of the credit meter 224 may be updated in response to outcomes of a game of chance or skill played at the gaming device 108 and/or in response to occurrences or outcomes of incidents associated with events the user 112 bet on at the gaming device 108 as part of a wagering session. In some embodiments, the credit meter 224 may be updated depending upon whether the gaming device 108 is issuing a ticket/voucher, being used as a point of redemption for a ticket/voucher, and/or any other activity associated with a ticket/voucher. Some or all of the data within the credit meter 224 may be reported to the video distribution server 116, for example, if such data applies to a centrally-managed game and/or a status of a ticket/voucher. As an example, the number, value, and timing of wagers placed by a particular user 112 and payouts on such wagers may be reported to the video distribution server 116.

The display presentation instruction set 228, when executed by the processor 204, may enable the gaming device 108 to provide various display and/or auditory presentations for a game played on the gaming device 108, a video management application 234 run on the gaming device 108, and/or a video presentation rendered via the display device 238 of the gaming device 108. For instance, based on an event, or an outcome of an event, or other incident associated with an event the user 112 has bet on in wagering session, the display presentation instruction set 228 may render one or more alerts, alarms, winning graphics, flashing lights, losing graphics, etc. In some embodiments, the display presentation instruction set 228 may alter a display presentation of the windows or elements rendered to a portion of a display device of the gaming device 108 based on a wager placed by the user 112 on an event. For the sake of example, when a user 112 bets on a particular sports team, the display presentation instruction set 228 may determine to render a particular presentation of the event (e.g., live video stream, alternative display presentation, etc.), alter a background image, windows, icons, and/or interactive elements via the gaming device 108 of the user 112. In some embodiments, when a user 112 places a bet on a particular sports team in an event, the display presentation instruction set 228 may determine to alter a text-based, or static 2D/3D simulation, of the event to a live video stream presentation of the event. The display presentation instruction set 228 may provide one or more commands to the display controller 236 and the display device 238 to control the rendered output throughout a user's 112 interaction, and/or wagering session, with the gaming device 108.

The wagering session instruction set 232, when executed by the processor 204, may enable the gaming device 108 to receive information from a wagering host server 144, receive input from a user 112 (e.g., via the user interface 216, etc.) placing a bet on an outcome associated with an event (e.g., on one or more incidents in the event, etc.). In some embodiments, the wagering session instruction set 232 may send a signal defining the bet placed to wagering host server 144 via the network interface 212 of the gaming device 108. The wagering session instruction set 232 may command the one or more cameras 278 of the gaming device 108 to take at least one image of the user 112 placing the bet (e.g., to confirm that the user 112 is authorized to place the bet, etc.). In any event, the wagering session instruction set 232 may work in conjunction with the display presentation instruction set 228 to render betting information (e.g., wagering opportunities, odds, etc.) obtained from the wagering host server 144 to a display device 238 of the gaming device 108.

The gaming device 108 may include one or more display devices 238 configured to render information, live video, communications windows, wagering interface windows, games, interactive elements, and/or other visual output to one or more display screens 248. The gaming device 108 may include one or more display controllers 236 configured to control an operation of the display device 238. This operation may include the control of input (e.g., user 112 input via the user interface 216, command input via the instruction sets in memory 208, combinations thereof, etc.), output (e.g., display, rendered images, visual game behavior, etc.) and/or other functions of the display device 238.

The display device 238 may one or more display screens 248 that are configured to selectively activate pixels and/or display elements to render one or more games, windows, indicators, interactive elements, icons, characters, lights, images, etc. Examples of the display screen 248 may include, but are in no way limited to, a liquid crystal display (LCD), a light-emitting diode (LED) display, an electroluminescent display (ELD), an organic LED (OLED) display, and/or some other two-dimensional and/or three-dimensional display. In some embodiments, the one or more display screens 248 may be separated into a main display and a secondary display. In a gaming device 108 context, the main display may correspond to a display arranged in a first viewing position of a user 112 and the secondary display may correspond to a display arranged in a second (e.g., higher) viewing position of the user 112. It is an aspect of the present disclosure that the gaming device 108 may include any number of display screens 248 in any arrangement or orientation (e.g., stacked, side-by-side, staggered, overlapped, angled, and/or combinations thereof). As described herein the display device 238 may be configured to render information in one or more discrete areas (e.g., windows, portions, zones, backgrounds, etc.) of the display screen 248 or superimposed in an area of the display screen 248.

The display device 238 may include a display driver 252, a power supply 256, an input/output 260, and/or other components 264 configured to enable operation of the display device 238. The display driver 252 may receive commands and/or other data provided by the processor 204 and one or more of the instruction sets in memory 208. In response to receiving the commands, the display driver 252 may be configured to generate the driving signals necessary to render the appropriate images to the display screen 248. The power supply 256 may provide electric power to the components of the display device 238. In some embodiments, the power supply 256 may include a transformer and/or other electronics that prevent overloading, condition power signals, and/or provide backup power to the display device 238. The input/output 260 may correspond to one or more connections for receiving or exchanging information and/or video from components of the gaming device 108. The input/output 260 may include an interconnection to the network interface 212. For example, the input/output 260 may include a high-definition multimedia interface (HDMI) input, Ethernet, composite video, component video, H.264, or other video connection. In some embodiments, the display device 238 may be configured to receive a live video feed via the input/output 260 and the network interface 212. For instance, the display device 238 may render a live video stream event presentation received from the video distribution server 116 (e.g., via one or more video sources 110A-N, etc.) and/or an alternative event presentation based on information received from the wagering host server 144.

The cash-in device 240 may include a bill acceptor, a coin acceptor, a chip acceptor or reader, or the like. In some embodiments, the cash-in device may also include credit card reader hardware and/or software. The cash-out device 244, like the ticket issuance device 270, may operate and issue cash, coins, tokens, or chips based on an amount indicated within the credit meter 224. In some embodiments, the cash-out device 244 may include a coin tray or the like and counting hardware configured to count and distribute an appropriate amount of coins or tokens based on a user's 112 winnings or available credit within the credit meter 224.

Because the gaming device 108 may be used for the acceptance and issuance of tickets/vouchers, the gaming device 108 may be provided with appropriate hardware to facilitate such acceptance and issuance. Specifically, the gaming device 108 may be provided with a ticket acceptance device 270 that is configured to accept or scan physically-printed tickets/vouchers and extract appropriate information therefrom. In some embodiments, the ticket acceptance device 270 may include one or more machine vision devices (e.g., a camera, IR scanner, optical scanner, barcode scanner, etc.), a physical ticket acceptor, a shredder, etc. The ticket acceptance device 270 may be configured to accept physical tickets and/or electronic tickets without departing from the scope of the present disclosure. An electronic ticket/voucher may be accepted by scanning a one-dimensional barcode, two-dimensional barcode, or other type of barcode or quick response (QR) code displayed by a user's 112 mobile device 142, for example. In one embodiment, an impersonal player ID may be present on the electronic ticket/voucher as part of the barcode, QR code, or other visible information on the electronic ticket/voucher.

The ticket issuance device 274 may be configured to print or provide physical tickets/vouchers to users 112. In some embodiments, the ticket issuance device 274 may be configured to issue a ticket/voucher consistent with an amount of credit available to a user 112, possibly as indicated within the credit meter 224.

The gaming device 108 may include at least one camera 278, or image capture device, that is configured to capture still and/or video images in proximity to the gaming device 108. The camera 278 may include, or be associated, with additional devices, such as light sources, flashes, infrared emitters, etc., to provide a clear image capture environment. As provided herein the camera 278 may be controlled by the processor 204 in conjunction with signals from the wagering session instruction set 232 and/or other instruction sets in memory 208.

Figure 3A:
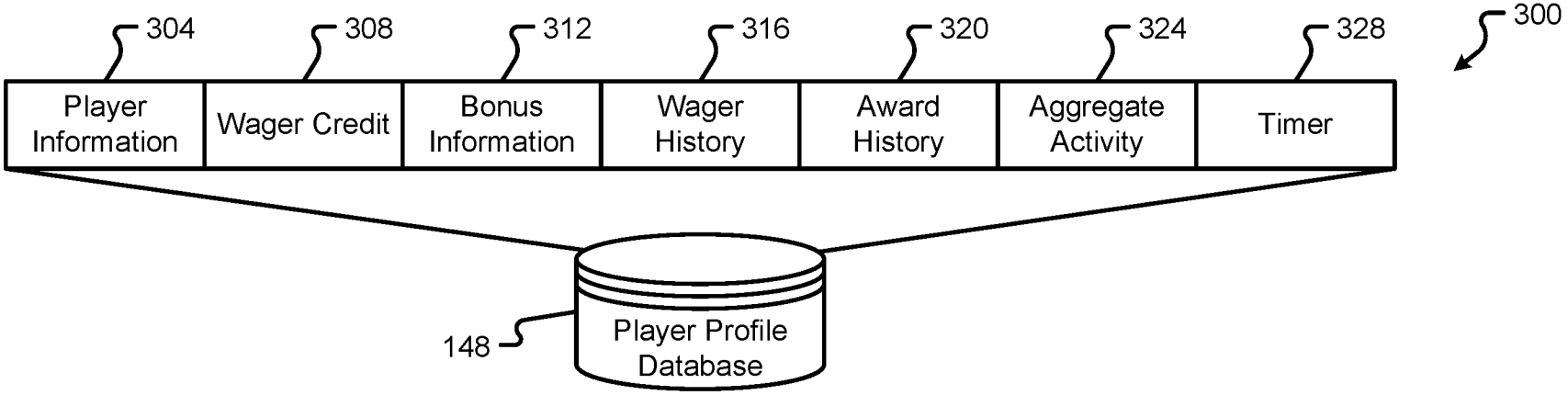
FIG. 3A is a block diagram depicting a first illustrative data structure used in accordance with embodiments of the present disclosure.
Figure 3B:
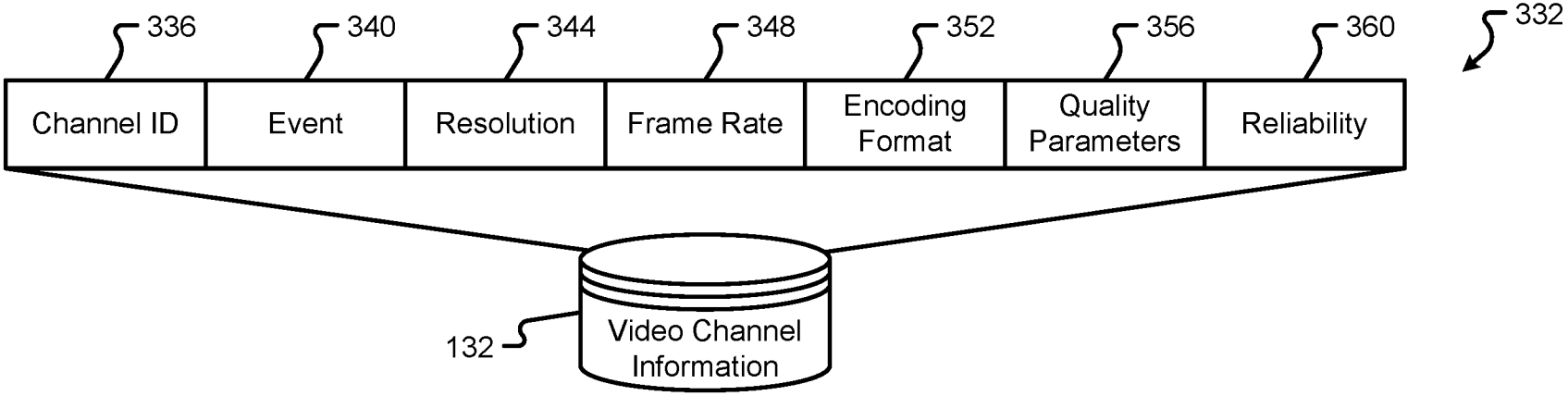
FIG. 3B is a block diagram depicting a second illustrative data structure used in accordance with embodiments of the present disclosure.

With reference now to FIGS. 3A and 3B, additional details of data structures that are useable in connection with managing player profiles and video management behavior will be described in accordance with at least some embodiments of the present disclosure. It should be appreciated that the data structures depicted and described herein may be stored within a central database or may be distributed among a number of data storage nodes. Additionally or alternatively, some or all of the fields of the data structures may be maintained in devices of the event wagering and presentation system 100 such as the video distribution server 116, a betting system server 144, and/or a gaming device 108 (e.g., a mobile device 142, etc.) without departing from the scope of the present disclosure.

With reference initially to FIG. 3A, details of a data structure 300 that may be maintained as part of a user, or player, profile will be described in accordance with at least some embodiments of the present disclosure. The database 148 may be configured to store one or multiple data structures 300 that are used in connection with tracking player progress, wager history, and gaming activity. As a non-limiting example, the data structure 300 may be used to store wagers made, player history information, and the like. Even more specifically, the data structure 300 may include a plurality of data fields that include, for instance, player information field 304, a wager credit field 308, a bonus information field 312, a wager history field 316, an award history field 320, an aggregate activity field 324, and a timer field 328.

The player information field 304 may be used to store any type of information that identifies a user 112 or a group of users 112. In some embodiments, the player information field 304 may store one or more of username information for a user 112, password information for a player account, player status information, accommodations associated with the user 112, and any other type of customer service management data that may be stored with respect to a user 112. Additionally or alternatively, the player information field 304 may store the user's 112 teams, avatars, sports, friends, contacts, preferred display layouts (e.g., number of portions, sizes of portions, colors, backgrounds, logos, video settings, resolutions, frame rates, etc.), and/or other preferences associated with the user 112.

The wager credit field 308 may be used to store data about a user's 112 available credit with a casino, wagering system, or a plurality of casinos. For instance, the wager credit field 308 may store an electronic record of available credit in the user's 112 account and whether any restrictions are associated with such credit. The wager credit field 308 may further store information describing a user's 112 available credit over time, cash out events for the user 112, winning events for the user 112, and the like. In some embodiments, the wager credit field 308 may store information describing amounts won and/or lost from wagering on events, amounts won and/or lost from playing a game of the gaming device 108, and/or other betting associated with the user 112.

The bonus information field 312 may be used to store information describing bonuses that have been paid to the user 112 or that are available to be paid in response to particular incidents occurring for a wager placed by the user 112 on an event. As a non-limiting example, the bonus information field 312 may be used to store electronic records for values of awards that are available to or have been paid to the user 112. Even more specifically, the bonus information field 312 may store values of awards that will be paid to the user 112 if a particular outcome (e.g., an incident) occurs within a predetermined amount of time (as monitored by a timer value in the timer field 328) and to store a value of an award that will be paid to the user 112 if a plurality of particular outcomes occur. In some embodiments, a value representing a predetermined award for a single incident occurring may be less than a value representing a predetermined award for a plurality of incidents occurring in an event. The bonus information field 312 may also be used to store probability information or odds associated with a particular outcome occurring or a plurality of particular outcomes occurring. In some embodiments, the probability of a single outcome occurring in an event may be greater than a probability of a plurality of outcomes occurring in the event, regardless of whether or not the plurality of outcomes include the single outcome. In one embodiment, the bonus information field 312 may include information about which bonus opportunities a user 112 has registered for, been enrolled in, or automatically entered based on participating in one or more wagering sessions.

The wager history field 316 may be used to store historical data for wagers made by a user 112. The wagers may be made a particular gaming device 108 and may be related to one or more events. The wager history field 316 may include information describing wagers made by a user 112 over time including, but in no way limited to, one or more of a wager type (e.g., money lines, over/under, parlays, place, point spread, show, win, etc.), a wager or bet amount, an event associated with a wager, a particular sports team or person wagered on, terms of the wager, related wagers, etc., and/or combinations thereof. The information stored in the wager history field 316 may include a timestamp for each wager made, for example, defining when the wager was made, paid out, collected, or otherwise closed. The timestamps may be used to determine timing associated with wagers made by a user 112 at a gaming device 108, a presentation of an event wagered on by the user 112, organizing data, and/or the like. The information in the wager history field 316 may be used to track a history of wagers in which the user 112 participated. In some embodiments, the information stored in the wager history field 316 may be received from user 112 input at a gaming device 108, the wagering host server 144, and/or the video distribution server 116.

The award history field 320 may store data related to awards, bonuses, mini-bonuses, score multipliers, jackpots, etc., granted to the user 112. The award history field 320 may also indicate when such awards were granted to the user 112, whether the awards have been redeemed, whether the awards are being funded by a game of chance or skill, a bet placed in a wagering session at the gaming device 108, a bet placed on an event (e.g., on one or more outcomes associated with the event or incidents occurring in the event, etc.), a mini-bonus associated with an event, or a jackpot award associated with the user 112 completing a plurality of events. In some embodiments, the award history field 320 may comprise data regarding losses associated with the user 112. For instance, the award history field 320 may be used to track amounts lost, amounts won, and/or draws associated with one or more wagering sessions in which the user 112 participated. The information in the award history field 320 may be used by the video distribution server 116 and/or a gaming device 108 to determine a wagering behavior and/or player rank of a particular user 112. For example, the video distribution server 116 may determine based on the information in the award history field 320 that a particular user 112 is a preferred player, for example, a user who has reached a predetermined player rank and/or a user who routinely places bets on events, etc. In response, the video distribution server 116 may provide the particular user 112 access, via the gaming device 108, to live video streams of events having video quality parameters that are higher than are available to other users 112 who are not identified as preferred.

The aggregate activity field 324 may also be used to store event information related to a plurality of activities that are to occur if the user 112 is to win a jackpot award or the like. Furthermore, the aggregate activity field 324 may store information related to wagers initiated by a user 112 in connection with trying to complete the plurality of activities and whether any portions of such wagers are being used to fund a jackpot pool (e.g., parlay pool, progressive pool, mystery progressive, etc.), associated with other users 112 competing in the same wagering session. In some embodiments, the aggregate activity field 324 may include a rank of the user 112 compared to other users 112 wagering in the event wagering and presentation system 100. As can be appreciated, if the user 112 has more wins than other users 112 in the event wagering and presentation system 100 or the greatest number of wins among a group of users 112 in a number of wagering sessions, then that user 112 may have a first place, or top, ranking. Conversely, if the user 112 has fewer wins than other users 112 in the event wagering and presentation system 100 or the fewest number of wins among a group of users 112 in the wagering sessions, then that user 112 may have a last place, or bottom, ranking.

Based on the number of wins and/or losses, the users 112 in the event wagering and presentation system 100 may be ranked between and including the first and last place rankings.

As discussed above, the timer field 328 may be used to store a timer value associated with tracking whether or not a particular user 112 has won a wager on, or completed, a particular activity or a plurality of activities within a predetermined amount of time. The value of the timer within the timer field 328 may count up, count down, or increment in any known way to track a passage of time. Alternatively or additionally, time may be measured by an occurrence of activities within the event wagering and presentation system 100 rather than being measured absolutely. Specifically, the predetermined amount of time associated with determining whether a user 112 has completed an activity or a plurality of activities before some other user 112 within the system 100 has completed the same activity or plurality of activities. Thus, the timer does not necessarily have to count a passage of time with seconds and minutes, but rather may be counting a passage of time based on activities or other incidents that occur within the system 100. Such information may be maintained within the timer field 328.

FIG. 3B shows details of another data structure 332 that may be used within the event wagering and presentation system 100 in accordance with at least some embodiments of the present disclosure. In some embodiments, the video channel information data structure 332 may be stored in the video channel information 132 memory, the event database 160, or some other internal memory of the gaming device 108 and/or the video distribution server 116. In any event, one or more video channel information data structures 332 may be used in connection with providing a display and/or output presentation for rendering by a gaming device 108. In some embodiments, the data stored in the video channel information data structure 332 may be stored for a plurality of different channels and/or video sources 110A-N. As a non-limiting example, the data structure 332 may be used to store a channel identification (ID), a current event associated with the channel, and associated video parameters for the channel. Even more specifically, the data structure 332 may include a plurality of data fields that include, for instance, a channel ID field 336, an event field 340, a resolution field 344, a frame rate field 348, an encoding format field 352, a quality parameters field 356, and a reliability field 360. It should be appreciated that the data structure 332 may have greater or fewer fields than depicted in FIG. 3B. In some embodiments, the video channel information data structure 332 may store information associated with one or more channels of a single video source 110A-D and/or one or more channels of a plurality of video sources 110A-D. The information stored in the video channel information data structure 332 may change over time. Stated another way, at a first time, the video channel information data structure 332 may include information for a channel at the first time and, at a second later time, the information for the channel may be updated to reflect any changes.

The channel ID field 336 may be used to store information that identifies a channel available to the video distribution server 116. The ID of the channel may include, but is in no way limited to, an URL, a network address, an IP address, a channel number, a channel name, a string of two or more alphanumeric characters, and/or some other unique identifier that distinguishes one channel from another. In some embodiments, the ID of the channel stored in the channel ID field 336 may be received from one or more video sources 110A-N. In one embodiment, the video distribution server 116 may comprise a video encoder 114 that, among other things, generates a unique ID for the channel received from the one or more video sources 110A-N. The unique ID may be stored in the channel ID field 336 of the video channel information data structure 332. Additionally or alternatively, the channel ID field 336 may include an identification of the video source 110A-N providing the channel. For instance, a first channel 166A may be associated with a first video source 110A and a second channel 166B may be associated with a second video source 110B, etc. In some embodiments, the video distribution server 116 may access the information about video sources 110A-N contained in the channel ID field 336 to determine whether a particular video source 110A-N has a problem (e.g., providing poor quality video, intermittent reliability of the video stream, etc.) or has failed to provide a video output.

The event field 340 may be used to store information that identifies an event that is playing on the channel indicated in the channel ID field 336. As provided above, the event may correspond to a live sporting event, live horse racing event, live competitive contest, television show, and/or other type of event having a video associated therewith. In some embodiments, the event field 340 may identify the specific type of event and provide details about the event. For example, the event field 340 may identify that a football game (e.g., the type of event) is playing on a first channel 166A (e.g., stored in the channel ID field 336) at a first time between the Patriots and the Broncos (e.g., the details of the event). In some embodiments, the event field 340 may be used to store information about whether a corresponding wagering opportunity for the event exists in a wagering host server 144 or the like. The information stored in the event field 340 may change over time. Stated another way, at a first time, a first event may be playing on the channel indicated in the channel ID field 336 and, at a second later time, a second different event may be playing on the channel. The video distribution server 116 and/or a gaming device 108 may refer to the event field 340 of the video channel information data structure 332 at one or more times (e.g., continuously, at intervals, etc.) to determine matches between the event playing on the channel and wagering opportunities in the wagering host server 144.

The resolution field 344 may be used to store information about a current video display resolution of the live video stream of the event playing on the channel indicated in the channel ID field 336. The display resolution stored in the resolution field 344 may identify an aspect ratio and a number of pixels that are capable of being displayed by a display device (e.g., the display device 238 of a gaming device 108, etc.). For instance, a display resolution of 320×200 indicates a display device would be able to render the live video stream of the event in a format that is 320 pixels in width by 200 pixels in height. Examples of display resolutions that can be stored in the resolution field 344 may include, but are in no way limited to, 320×240 (QVGA), 480×320 (CGA), 640×480 (VGA), 1024×768 (XGA), 1280×720 (HD 720), 1920×1080 (HD 1080), 2048×1080 (2K), 4096×2160 (4K), etc., and/or any other display resolution capable of being rendered by a display device. Display resolutions over and including HD 720 may be referred to herein as "high-resolution," while display resolutions under HD 720 may be referred to herein as "low-resolution." Similar to other fields of the video channel information data structure 332, the information stored in the resolution field 344 may change over time. For example, at a first time, a first display resolution for an event playing on the channel indicated in the channel ID field 336 may be available and, at a second later time, a second different display resolution for the event playing on the channel may be available. The display resolution may change from the first time to the second time based on a number of factors associated with the video stream of the channel such as the quality of the connection to the video source 110A-N, interference with the video stream signal, bandwidth available for the channel, etc., and/or combinations thereof. The video distribution server 116 and/or a gaming device 108 may refer to the resolution field 344 of the video channel information data structure 332 at one or more times (e.g., continuously, at intervals, etc.) to determine a particular presentation of the event for display.

The frame rate field 348 may be used to store information about a current frame rate of the live video stream of the event playing on the channel indicated in the channel ID field 336. The frame rate stored in the frame rate field 348 may indicate a frequency at which frames of the live video stream are capable of being displayed a display device (e.g., the display device 238 of a gaming device 108, etc.). The frame rate may be defined as a particular number of frames per second (FPS) for the live video stream. Examples of frame rates that can be stored in the frame rate field 348 may include, but are in no way limited to, 24 FPS, 30 FPS, 60 FPS, 120 FPS, 240 FPS, 300 FPS, etc., and/or any other frame rate capable of being rendered by a display device. The information stored in the frame rate field 348 may change over time. At a first time, for instance, a first frame rate for an event playing on the channel indicated in the channel ID field 336 may be available and, at a second later time, a second different frame rate for the event playing on the channel may be available. The frame rate may change from the first time to the second time based on a number of factors associated with the video stream of the channel such as the quality of the connection to the video source 110A-N, interference with the video stream signal, bandwidth available for the channel, etc., and/or combinations thereof. In one embodiment, the frame rate may be initially set to a specific frame rate based on frame rate specifications of the video source 110A-N providing the channel. The video distribution server 116 and/or a gaming device 108 may refer to the frame rate field 348 of the video channel information data structure 332 at one or more times (e.g., continuously, at intervals, etc.) to determine a particular presentation of the event for display.

The encoding format field 352 may be used to store information about an encoded video format of the live video stream of the event playing on the channel indicated in the channel ID field 336. The encoded video format defines a particular video compression standard of the live video stream. As provided herein, the one or more video sources 110A-N may provide video streams to the video distribution server 116 in a first format 162A. In some embodiments, the first format 162A of the video stream may need to be encoded to be distributed to one or more gaming devices 108 in the event wagering and presentation system 100. The video distribution server 116 may comprise a video encoder 114, which may be part of a set-top box 164 or a standalone device that converts the first format 162A into a second format 162B compatible with the gaming devices 108. By way of example, the live video stream may be provided to the video distribution server 116 in an HDMI format (e.g., over coaxial cable, etc.) and the video encoder 114 (e.g., of the video distribution server 116) may convert the HDMI format into an H.264 format of video compression, which can then be provided to the gaming devices 108 (e.g., over Ethernet, etc.). In some embodiments, the encoding format field 352 may include an indication of the first format 162A of the live video stream, an indication of the second format 162B of the live video stream, and/or an indication of both the first and second formats 162A, 162B of the live video streams associated with different times of encoding.

The quality parameters field 356 may be used to store information about a quality of the live video stream of the event playing on the channel indicated in the channel ID field 336. The quality parameters field 356 may include a rating and/or one or more threshold values for the quality of the live video stream based on one or more of the display resolution, frame rate, and reliability of the live video stream stored in the video channel information data structure 332. In some embodiments, the quality parameters may define a "poor," "fair," "good," or "excellent" rating of quality depending on a number of factors. Although labeled as "poor," "fair," "good," and "excellent," it should be appreciated that any rating from worst to best, respectively, can be employed in aspects of the present disclosure. In some embodiments, when one or more of a display resolution, frame rate, or reliability, falls below one or more threshold values, the quality rating for the live video stream may be lowered from a previous rating to a lower rating (e.g., from "excellent" to "good," from "fair" to "poor," from "good" to "poor," etc.). Additionally or alternatively, when one or more of the display resolution, frame rate, or reliability, increments above the one or more threshold values, the quality rating for the live video stream may be increased from a previous rating to a higher rating (e.g., from "good" to "excellent," from "poor" to "fair," from "poor" to "good," etc.). The video distribution server 116 and/or a gaming device 108 may refer to the quality parameters field 356 of the video channel information data structure 332 at one or more times (e.g., continuously, at intervals, etc.) to determine whether a change to a particular presentation of the event (e.g., via the gaming device 108) should be made. In some embodiments, the video distribution server 116 and/or the gaming device 108 may refer to the resolution field 344, the frame rate field 348, the reliability field 360, etc., separately or in combination to determine whether the change to the particular presentation of the event should be made.

The reliability field 360 may be used to store information about a reliability of the live video stream of the event playing on the channel indicated in the channel ID field 336. The reliability of a stream may refer to acceptable deviations in signal strength, errors in packet transmission, interference, interruptions, recovery time, and/or the like associated with the live video stream over time. In some embodiments, the live video stream may have a display resolution, frame rate, and/or other quality parameters that all fall within acceptable threshold values for the live video stream. However, in some cases, this live video stream may suffer from intermittent interruptions or drops, which can negatively affect the viewing experience of the event at a gaming device 108. The reliability field 360 may store information associated with the channel indicated in the channel ID field 336 for one or more points in time. The video distribution server 116 and/or the gaming device 108 may refer to the information stored in the reliability field 360 to determine whether the reliability of the live video stream associated with the channel falls within predetermined acceptable levels. When the reliability fails to fall within the predetermined acceptable levels, the video distribution server 116 and/or the gaming device 108 may alter a presentation of the event rendered by the gaming device 108.

With reference now to FIGS. 4A-4F, representative images of a display screen 248 of a gaming device 108 exhibiting various composite presentations are shown in accordance with at least some embodiments of the present disclosure. The gaming device 108 may render any casino game, live video presentation of an event, and/or wagering information to the display area 400 of the display screen 248. In some embodiments, the display screen 248 may include a background configured to display a background image. The display area 400 may be separated into two or more display portions 406A-406F or areas. Although shown as including six different portions 406A-406F, it should be appreciated that the display area 400 may include greater or fewer portions, in similar or different proportions and/or sizes, than illustrated in FIG. 4A. In addition, one or more windows, display elements, or interactive features may cross over one or more of the portions 406A-406F illustrated in FIG. 4A. Stated another way, a window may at least partially fill a single portion 406A-406F of the display area 400 or an area defined by multiple portions 406A-406F of the display area 400. By way of example, the first presentation window 404A shown in FIG. 4B may substantially fill an area of the display area 400 defined by the first portion 406A, the second portion 406B, and the fourth portion 406D, together, while the game window 408 is shown as substantially filling the third portion 406C of the display area 400. Continuing with the example presentation shown in FIG. 4B, the wagering interface window 412 may substantially fill an area of the display area 400 defined by the fifth portion 406E and the sixth portion 406F together.

The display device 238 may be configured to render, via a video management application 234 (e.g., running on the gaming device 108 and/or the video distribution server 116), a first presentation window 404A, a game window 408, and/or a wagering interface window 412. Additionally or alternatively, the display device 238 may be configured to render one or more other windows to the display area 400. As provided above, the display area 400 of the display screen 248 may be divided into separate, or discrete, areas or screen portions 406A-406F. It is an aspect of the present disclosure that the position of these areas may be moved, resized, minimized, superimposed, created, and/or removed, based at least on an event the user 112 has bet on in a wagering session. In one embodiment, a live video presentation of the event may be rendered to the first presentation window 404A (e.g., received from a video server, video source 110A-N, and/or video distribution server 116, etc.). The game window 408 may provide a gaming interface for a user 112 to play a game associated with the gaming device 108 (e.g., provided by the gaming device 108 and/or a gaming server, etc.). The wagering interface window 412 may allow a user 112 to initiate, manage, and/or track wagers made (e.g., from the gaming device 108, betting terminal, etc.). In some embodiments, the wagering interface window 412 may receive information from the wagering host server 144, wagering database 152, the video distribution server 116, and/or other devices in the event wagering and presentation system 100. The wagering interface window 412 may include odds and/or other information associated with existing or potential wagers, events, and/or the like.

Additional details regarding the video management application 234 providing the user interface elements (e.g., windows, selection buttons, etc.) rendered to the display area 400 of the display device 238 will be described in conjunction with FIGS. 4B-4F.

Figure 4A:
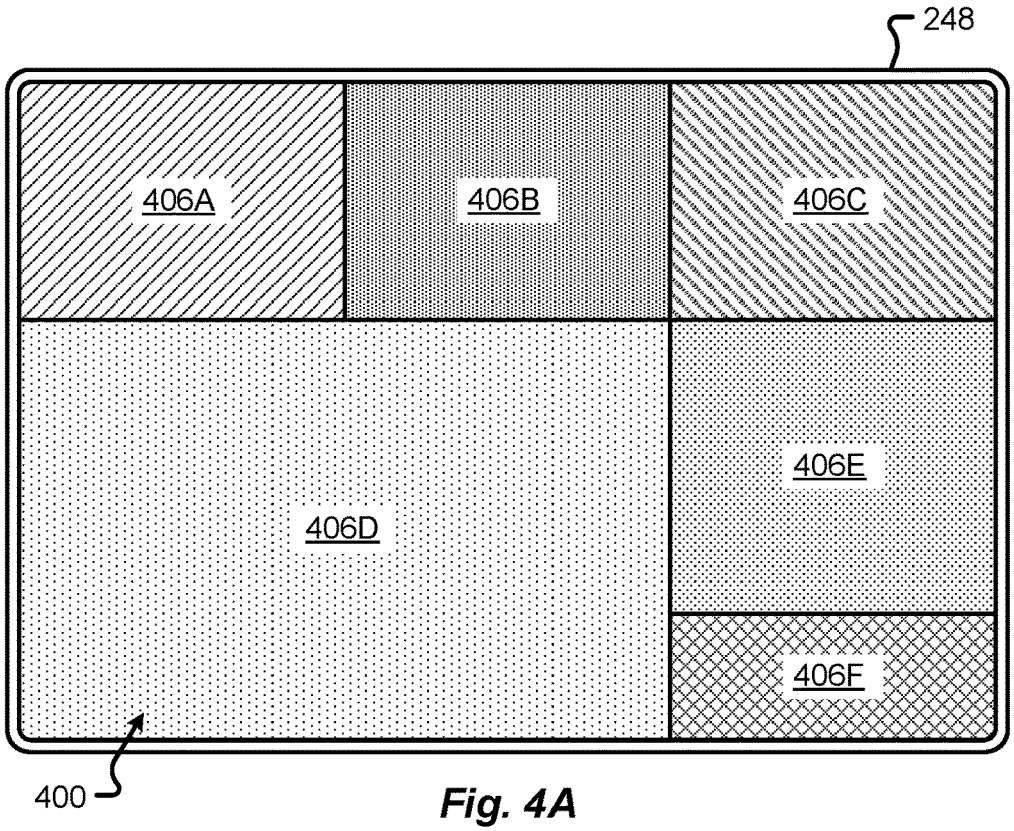
FIG. 4A is a schematic diagram of a screen of a gaming device in a segmented presentation in accordance with embodiments of the present disclosure.

FIG. 4A shows a representative image of a display screen 248 of a gaming device 108 in a first presentation arrangement in accordance with embodiments of the present disclosure. The display screen 248 in the first presentation arrangement includes a display area 400 configured to render a first presentation window 404A, a game window 408, and an wagering interface window 412, optionally over a background image. In the first presentation arrangement, the first presentation window 404A is rendered to a first portion 406A, second portion 406B, and a fourth portion 406D of the display area 400, the game window 408 is rendered to a third portion 406C, and wagering interface window 412 is rendered to the fifth portion 406E and the sixth portion 406F of the display area 400. In some embodiments, the first portion 406A, second portion 406B, and the fourth portion 406D together, or the fourth portion 406D alone, may be referred to as the "primary" window of the display area 400, while other smaller portions may be referred to herein as "non-primary" windows of the display area 400.

Figure 4B:
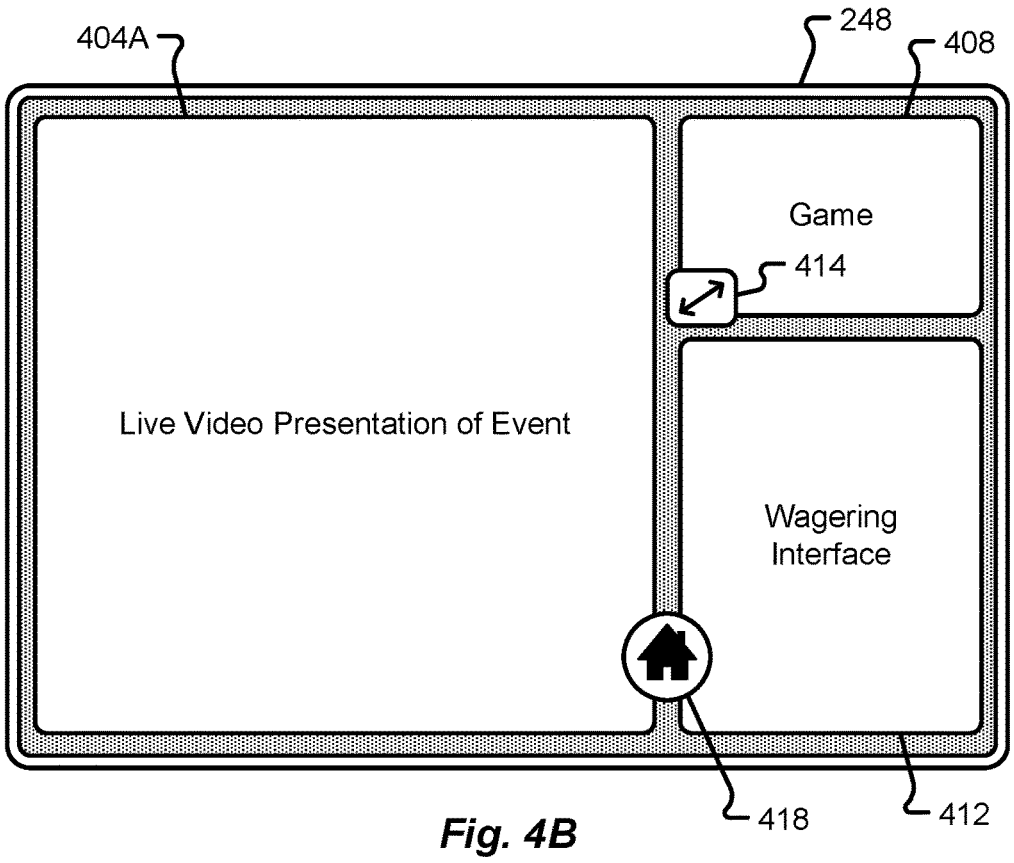
FIG. 4B is a representative image of a screen of a gaming device comprising an arrangement of windows with a primary window displaying a first presentation of an event in accordance with embodiments of the present disclosure.

In addition to the separate windows 404, 408, 412, the display area 400 may include interface elements that manipulate or alter a size and/or position of the windows and/or a navigation between applications running on the gaming device 108. For example, the display area 400 may include one or more window manipulation buttons 414. As shown in FIG. 4B, the window manipulation button 414 is illustrated in a corner of the game window 408. Although shown in this location, it should be appreciated that the window manipulation button 414 may be rendered to any portion or combination of portions of the display area 400. In some embodiments, the window manipulation button 414 may cause a particular window to expand, contract, move, or otherwise resize. Additionally or alternatively, the window manipulation button 414 may cause one window to swap positions with another window rendered to the display area 400. For instance, as shown in FIG. 4B, a user 112 may select the window manipulation button 414 to swap the first presentation window 404A with the game window 408 such that the content associated with the game window 408 is moved and resized (e.g., expanded) to be shown in the first portion 406A, second portion 406B, and fourth portion 406D of the display area 400 together (e.g., taking the place of the first presentation window 404A). In this example, the content of the first presentation window 404A may move and resize (e.g., shrink) into the third portion 406C (e.g., taking the place of the game window 408). In some embodiments, the display area 400 includes a navigation button 418 shown spanning over a portion of the first presentation window 404A and the wagering interface window 412. Although shown in this location, it should be appreciated that the navigation button 418 may be rendered to any portion or combination of portions of the display area 400. The navigation button 418 may provide a user 112 with the ability to navigate between applications, close windows, move windows off screen, and/or otherwise move among programs running on the gaming device 108.

It is an aspect of the present disclosure that one or more portions 406A-406F or windows 404, 408, 412 in the display area 400 may include data that is generated by the gaming device 108 or data that is received over at least one communication ports of the network interface 212. For example, content in first portion 406A may have data generated from the gaming device 108 itself or may present some data received over one port (e.g., a first communications port) of the network interface 212, whereas another portion 406B of the display area 400 may have data generated from a remote source and may be received over a different port (e.g., a second communications port). Additionally or alternatively, both portions 406A, 406B may have content received over the same network interface 212, but at different times and/or on different communication channels (even if received over the same port of the network interface 212).

The first presentation window 404A may be configured to render a live video of an event (e.g., a live sporting event, etc.) to the first portion 406A, second portion 406B, and the fourth portion 406D of the display area 400. In some embodiments, the live video may be of an event associated with a wager made by the user 112 in the event wagering and presentation system 100. The first presentation window 404A may stream live video about the event (e.g., a live football game, a live race, a basketball game, a baseball game, etc.) in real time or in near real time (e.g., as the event is underway or being played). In some embodiments, the game window 408 may change position or swap positions with the first presentation window 404A. While the event is underway, the user 112 participating in a wagering session may wager on outcomes of incidents associated with the event, or of the event itself, in real time.

The game window 408, shown rendered to the third portion 406C of the display 400 in FIG. 4B, may be configured to render an interactive casino game to the display screen 248. Examples of casino games that can be rendered to the interactive gaming window, or other window of the display area 400, may include, but are in no way limited to, poker, blackjack, craps, roulette, slots, bingo, keno, baccarat, dice games, and the like.

The wagering interface window 412 is shown rendered to the fifth portion 406E and the sixth portion 406F of the display area 400. The wagering interface window 412 may include information for a user 112 to engage in, initiate, manage, and/or track wagers in the event wagering and presentation system 100. The wagering interface window 412 may include a balance amount indicator, a wager detail area, a wager information area, a set amount selection button, an acceptance selection button, and a modification selection button. The balance amount indicator may be configured to render a credit amount in a player account associated with the user 112. The wager detail area may include information about a wager placed on an event in a wagering session. In some embodiments, the wager detail area may list conditions of the wager including, but in no way limited to, a bet amount, an event, an outcome associated with the event, a wagering position of the user 112, and/or any other wager specific information. In some embodiments, when the user 112 places a bet on an event, the gaming device 108 may render live video of the event to the first presentation window 404A. The wagering interface window 412 may include a wager information area that lists wagers made by the user 112, current wagers in which the user 112 is participating, and/or statistics associated with wagering by the user 112 in the event wagering and presentation system 100. In some embodiments, the wager information area may include a number of betting opportunities in the form of a list or presentation of events and/or incidents (e.g., scores, positions, plays, penalties, errors, injuries, calls, reviews, outcomes, results, etc.) associated with an event on which a user 112 may place a wager (e.g., from the gaming device 108).

The wagering interface window 412 may be configured to render odds associated with different betting opportunities. The odds may be in the form of a list or other presentation that relates a particular event with the odds (e.g., a predicted likelihood, etc.) associated with that incident occurring in the event. In some embodiments, the wagering interface window 412 may render the odds received from the wagering host server 144 and/or the wagering database 152.

Figure 4C:
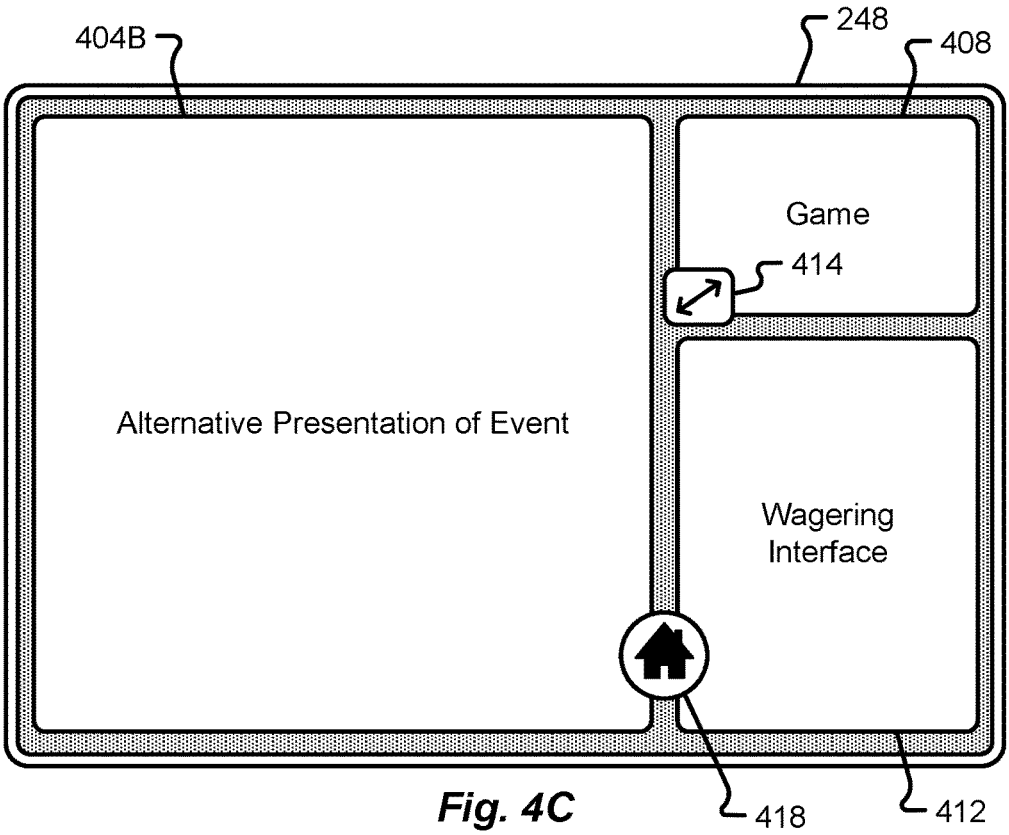
FIG. 4C is a representative image of a screen of a gaming device comprising an arrangement of windows with the primary window displaying a second presentation of the event in accordance with embodiments of the present disclosure.

FIGS. 4B and 4C show representative images rendered by a display screen 248 of a gaming device 108 comprising various presentations of an event rendered to the primary window (e.g., the first portion 406A, the second portion 406B, and the fourth portion 406D) of the display area 400. In some embodiments, a user 112 may wager on an event and, in response, the gaming device 108 may render live video of the event in a first presentation to the primary window of the display area 400. While the primary window is rendering live video of the event, the primary window may be referred to as the first presentation window 404A. The live video may correspond to a live video stream received from a video source 110A-N. While the event is underway, the gaming device 108 and/or the video distribution server 116 may receive play-by-play information about the event from a wagering host server 144 and/or wagering database 152. As can be appreciated, the play-by-play information may alter wagering opportunities, odds, and/or other features rendered to the wagering interface window 412. In some embodiments, the play-by-play information may be associated with specific incidents, outcomes, or other occurrences happening in the event. The play-by-play information may be received by the gaming device 108 as the specific incidents, outcomes, or other occurrences happen, for example, in real time.

In some embodiments, the gaming device 108 and/or the video distribution server 116 may determine to alter the presentation of the event rendered to the primary window (e.g., altering the first presentation window 404A to a different second presentation window 404B), as shown in FIG. 4C. This determination may be based on an input received from a user 112, an input received in response to detecting an unacceptable quality threshold of the video, an input associated with the wager made by the user 112, and/or some other triggering input. In any event, in response to receiving the input to alter the presentation of the event, the display screen 248 may render a second presentation window 404B as the primary window of the display area 400. Rather than rendering live video of the event in a first presentation to the primary window of the display area, the gaming device 108 may render an alternative presentation of the event (e.g., other than live video). In one embodiment, the alternative presentation of the event may correspond to a text-based description of the event, a 2D or 3D simulation, or representation, of the event, and/or some other play-by-play description of the event other than video. While the primary window is rendering the non-video play-by-play presentation of the event, the primary window may be referred to as the second presentation window 404B.

As described herein the play-by-play information may be received by the video distribution server 116 and/or the gaming device 108 from the wagering host server 144 and then rendered to the second presentation window 404B of the display screen 248 in lieu of video of the event. Among other things, this alteration of the presentation of the event allows a user 112 to continue to receive information (e.g., play-by-play information, simulated graphics, etc.) about an event even when a live video stream has failed in some way.

Figure 4D:
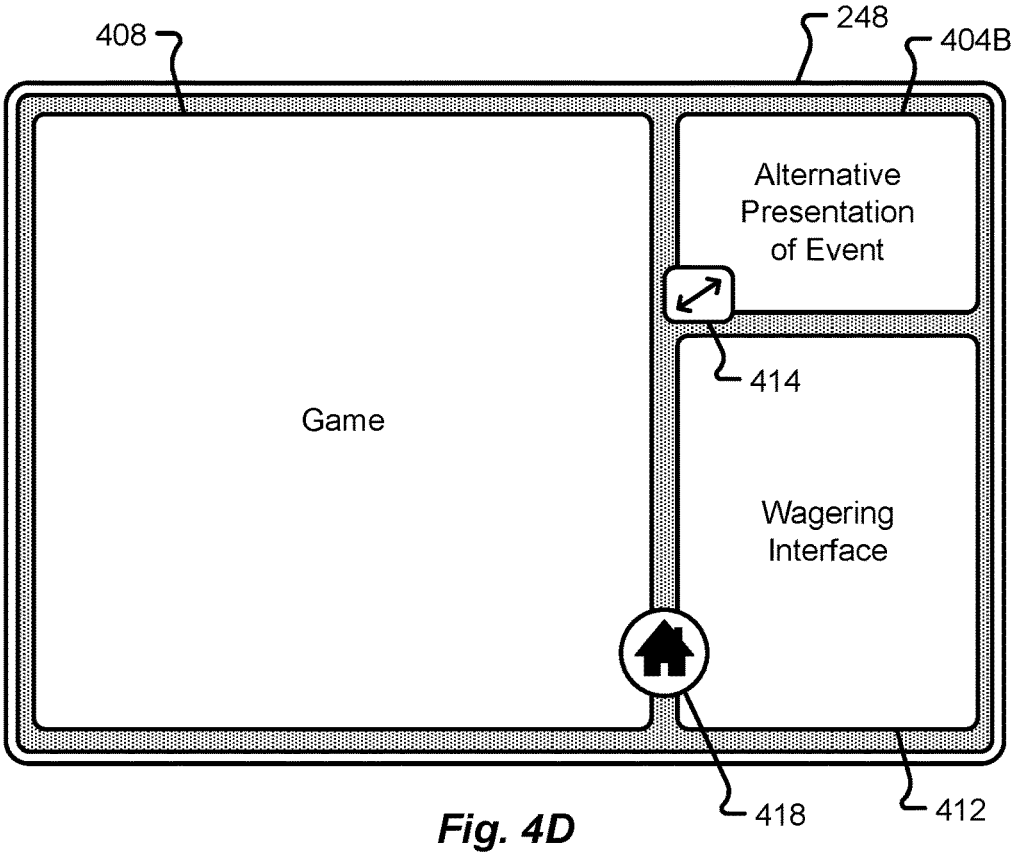
FIG. 4D is a representative image of a screen of a gaming device comprising an arrangement of windows with a non-primary window displaying the second presentation of the event in accordance with embodiments of the present disclosure.

Because the second presentation of the event shown in the second presentation window 404B does not include video of the event, the second presentation window 404B may be rendered to a different (e.g., smaller) portion of the display area 400. As illustrated in FIG. 4D, the second presentation window 404B has swapped positions with the game window 408. Stated another way, the second presentation window 404B is rendered to the third portion 406C of the display area 400 and the game window 408 is rendered to the fourth portion 406D of the display area 400 in FIG. 4D. While this swapping of display areas may be automatically made by the gaming device 108 in response to determining to alter the presentation of the event rendered to the display area 400, it should be appreciated that a user 112 of the gaming device 108 may provide an input via the window manipulation button 414 to swap the positions of the second presentation window 404B with the game window 408, or some other window.

Figure 4E:
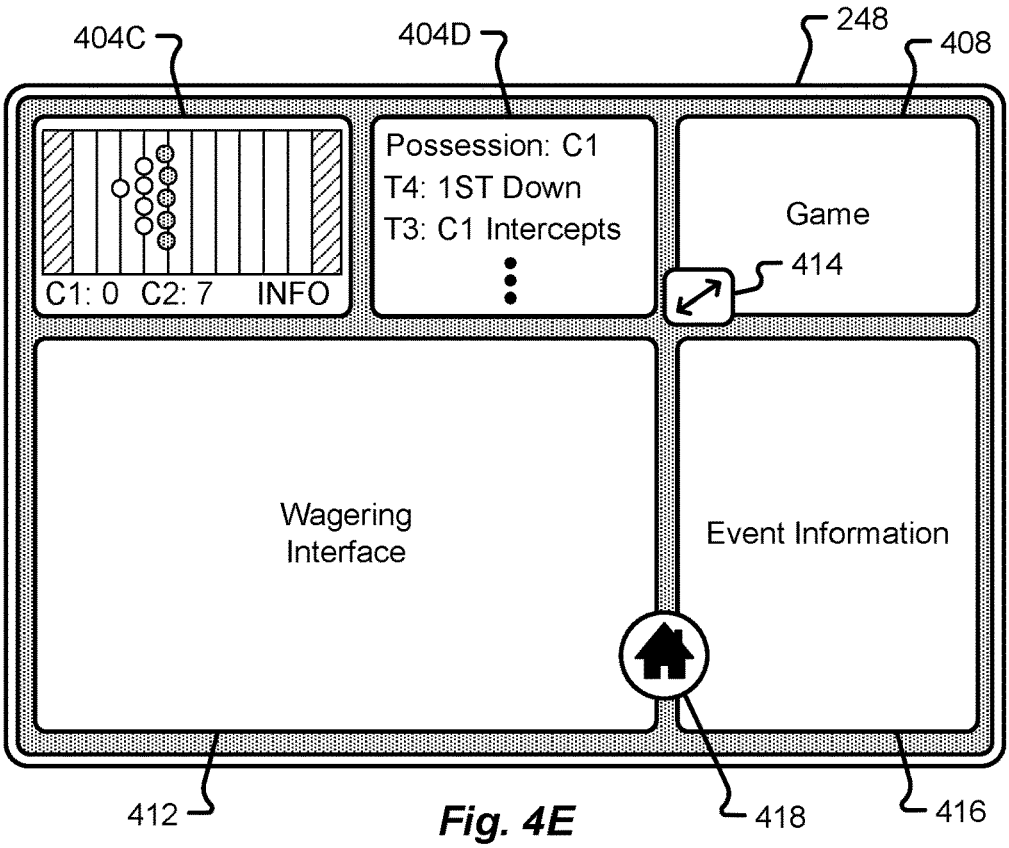
FIG. 4E is a representative image of a screen of a gaming device comprising an arrangement of windows with multiple non-primary windows displaying respective second presentations of the event in accordance with embodiments of the present disclosure.
Figure 4F:
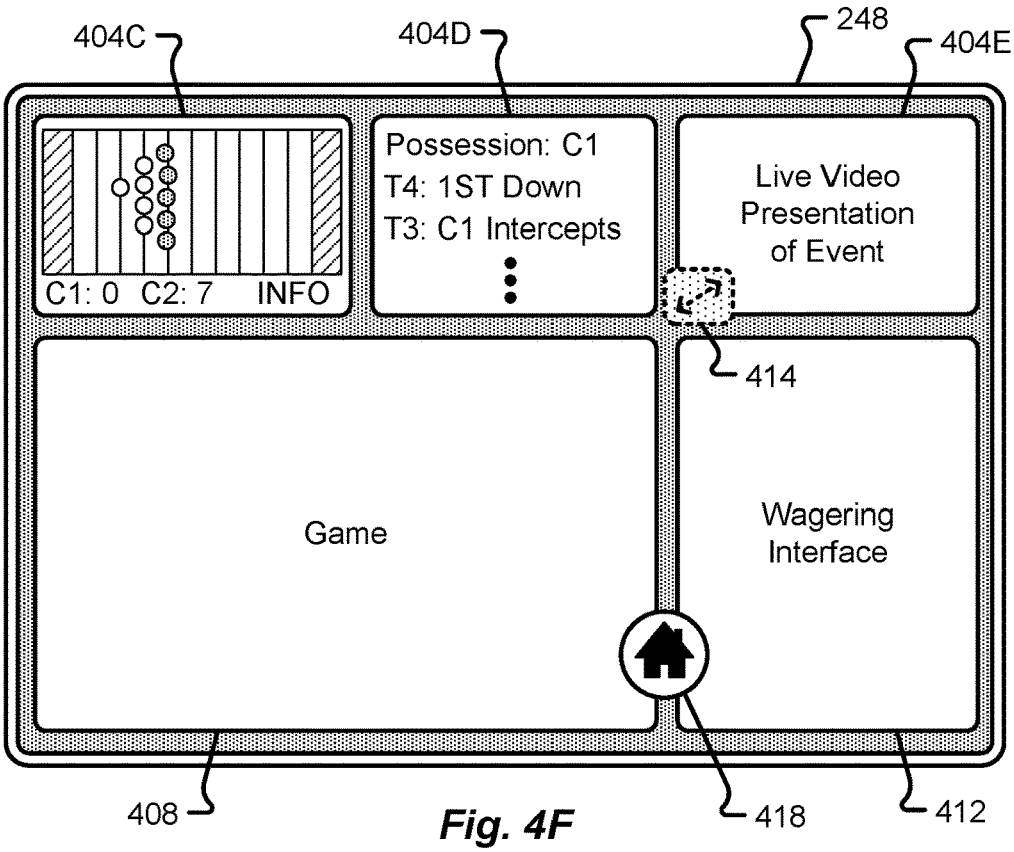
FIG. 4F is a representative image of a screen of a gaming device comprising an arrangement of windows with multiple non-primary windows displaying alternative presentations of the event in accordance with embodiments of the present disclosure.

FIGS. 4E and 4F show various images rendered by the display screen 248 comprising an arrangement of windows 404C, 404D, 404E displaying various presentations of the event in accordance with embodiments of the present disclosure. In particular, the third presentation window 404C rendered to the first portion 406A of the display area 400 corresponds to an alternative presentation of the event where a 2D simulation of the event is rendered based on the play-by-play information received from the wagering host server 144. The 2D simulation shown in the third presentation window 404C may include graphical elements representing a team, players of the team, a score, a playing field, and/or the like. As the event progresses, the graphical elements may change to reflect information in the play-by-play information. The fourth presentation window 404D rendered to the second portion 406B of the display area 400 corresponds to an alternative presentation of the event where a text-based description of the event is rendered based, for example, on the play-by-play information received from the wagering host server 144.

FIG. 4E may be representative of an arrangement of windows rendered to the display area 400 by the display screen 248 at a time prior to a user 112 placing a bet (e.g., wagering) on an event. In addition to the simplified, non-video, presentations rendered to the third and fourth presentation windows 404C, 404D, a game window 408 may be rendered to the third portion 406C, a wagering interface window 412 may be rendered to the wagering interface window 412, and an event information window 416 may be rendered to the display area 400. The event information window 416 may provide information on events that are underway (e.g., playing) or about to get underway (e.g., about to be played). In some embodiments, the event information window 416 may correspond to a sports guide, a program lineup, or the like. The information in the event information window 416 may be received from the one or more video sources 110A-N, the video distribution server 116, the wagering host server 144, and/or some other component of the event wagering and presentation system 100. In some embodiments, the gaming device 108 may be prevented from rendering live video to a portion of the display area 400 until a wager has been made by a user 112 on an event. In one embodiment, when a user 112 places a bet on an event, the arrangement of windows may change from those represented in FIG. 4E to, for example, the arrangement of windows shown in FIG. 4B. Since the user 112 placed the bet on the event, the display screen 248 may render the live video stream to the first presentation window 404A of the display area 400.

FIG. 4F may be representative of an arrangement of windows rendered to the display area 400 by the display screen 248 at a time when a video parameter (e.g., display resolution, frame rate, reliability, etc.) or other quality parameter associated with a live video stream fails to meet an acceptable threshold value. For instance, when the parameters of the live video stream fail to match a parameter requirement of the gaming device 108, the video distribution server 116, and/or the window to which the live video stream of the event is being rendered (e.g., first presentation window 404A of FIG. 4B), the gaming device 108 and/or the first video source 110A may determine to resize the live video stream to a non-primary window. In this example, the arrangement of windows represented in FIG. 4B may change to the arrangement of windows shown in FIG. 4F. As shown in FIG. 4F, a fifth presentation window 404E may be rendered to the third portion 406C of the display area 400 comprising a reduced-size (e.g., low-resolution, etc.) of the live video of the event than when displayed to the first presentation window 404A in FIG. 4B. It is an aspect of the present disclosure that the gaming device 108 and/or the video distribution server 116 may select a different video source for providing the live video of the event in the fifth presentation window 404E.

Additionally or alternatively, FIG. 4F may be representative of an arrangement of windows rendered to the display area 400 by the display screen 248 at a time prior to a user 112 placing a bet on an event. In some embodiments, the gaming device 108 may provide a reduced-size or low quality image of an event until a user 112 places a bet on the event. As shown in FIG. 4F, the window manipulation button 414 has been disabled (shown as greyed out), such that a user 112 cannot expand the size of the video rendered to the fifth presentation window 404E in this state of presentation. Once the user 112 places a bet on an event, the arrangement of windows represented in FIG. 4F may be changed to the arrangement of windows shown in FIG. 4B. Since the user 112 placed the bet on the event, the display screen 248 may render the live video stream to the first presentation window 404A of the display area 400 in a high-resolution size. Details of the operation of the event wagering and presentation system 100 will be described in conjunction with FIGS. 5-8.

Figure 5:
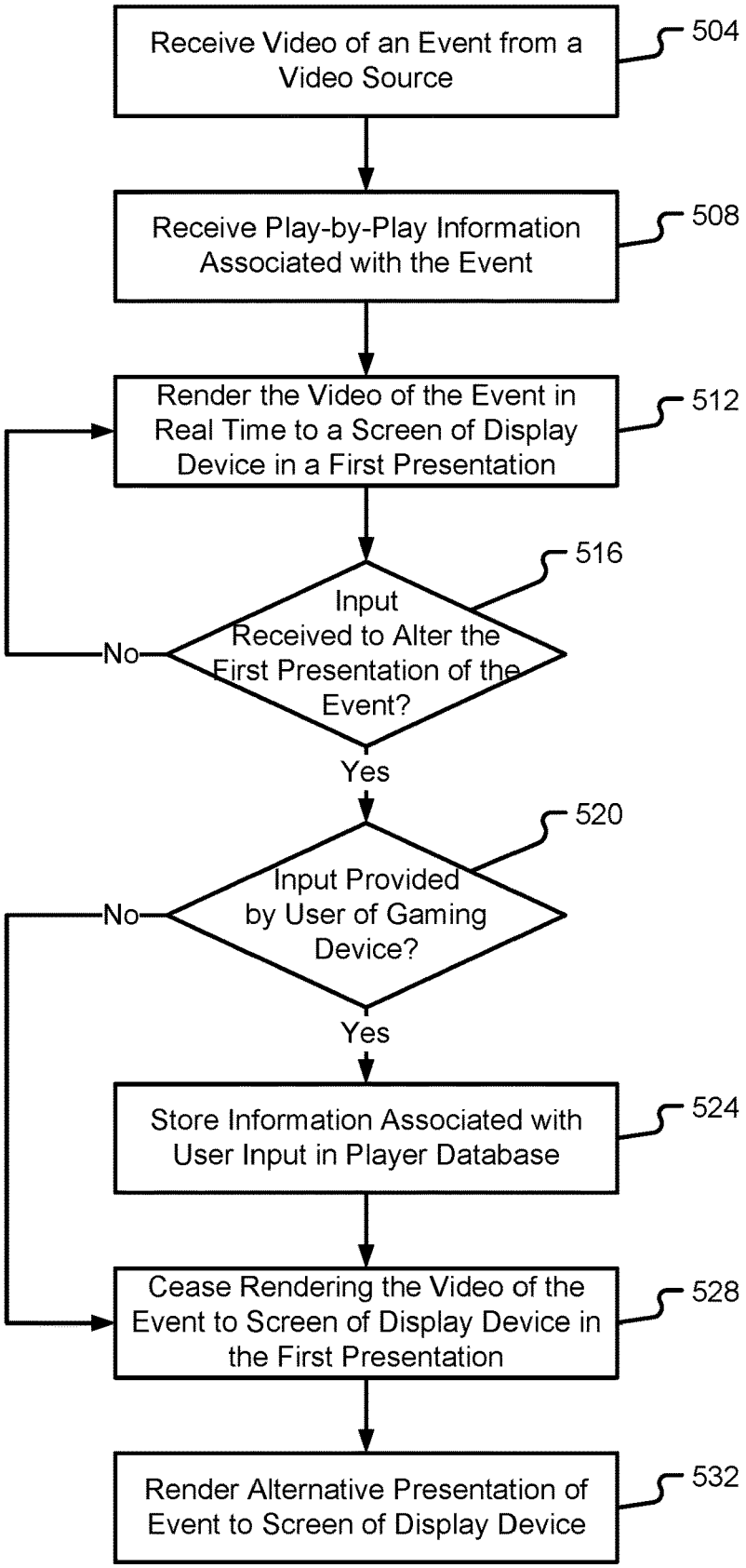
FIG. 5 is a flow diagram depicting a method of providing an alternative presentation of an event on a gaming device in accordance with embodiments of the present disclosure.

With reference now to FIG. 5, a flow diagram depicting a method of providing an alternative presentation of an event on the display screen 248 of a gaming device 108 is shown in accordance with embodiments of the present disclosure. The methods described herein may be run as a set of instructions on a gaming device 108, a video distribution server 116, and/or some other server of the event wagering and presentation system 100. In some embodiments, the set of instructions may be part of a video management application 234 installed on one or more of the gaming devices 108, video distribution server 116, and/or other server that manages the presentation of events rendered to gaming devices 108 in the event wagering and presentation system 100 in real time. In any event, the method begins by receiving video of an event from a video source 110A-N (step 504). The video may be part of a live video stream, for example, of a live sporting event. The video may be received across a communication network 104, via a communications interface (e.g., network interface 128, 212) in a first format 162A. In one embodiment, a video encoder 114 may convert the video from the first format 162A to a second format 162B compatible with the gaming devices 108.

Next, the method may continue by receiving play-by-play information associated with the event (step 508). The play-by-play information may be received across a communication network 104, via a communications interface, from a wagering host server 144 (e.g., a sports wagering host server, etc.). The play-by-play information describes a state of the event over time. More specifically, the play-by-play information can include, but is in no way limited to, information on scores, positions, plays, penalties, errors, injuries, calls, reviews, outcomes, results, occurrences, times associated therewith, and/or the like. In some embodiments, the play-by-play information may be received while the gaming device 108 is receiving the video of the event. In one embodiment, the play-by-play information may be received even when the gaming device 108 is not receiving the video of the event.

The method proceeds by rendering the video of the event in real time (e.g., as the event happens and as the video is received by the gaming device 108) to a portion of the display screen 248 of the gaming device 108 in a first presentation (step 512). This first presentation may correspond to any one of the live video presentations described in conjunction with the display area 400 above. In one embodiment, the video distribution server 116 may send a rendering command that causes the video of the event to be rendered, in real time, to a first portion of the display screen 248 of the gaming device 108.

The method continues by the video management application 234 of the gaming device 108 and/or the video distribution server 116 determining whether an input is received to alter the first presentation of the event to an alternative presentation of the event (step 516). The input may correspond to a signal received from a video source 110A-N, an input received from a user 112 interacting with the gaming device 108, a signal received from the video distribution server 116, an event timer, and/or other alternative presentation input received from one or more components in the event wagering and presentation system 100. The input may be based on the gaming device 108 and/or the video distribution server 116 determining that a video quality characteristic of the video falls below a predetermined quality threshold for display. If no input is received, the method returns to step 512 and continues to render the video of the event. When an input is received to alter the first presentation of the event, the method continues by determining the type of input received. More specifically, the method determines whether the input was provided by a user 112 interacting with the gaming device 108 (step 520).

When the video management application 234 determines that the input is provided by a user 112, the method proceeds by storing information about the input provided in a player profile database 148 associated with the user 112 (step 524). In some embodiments, the information about the input provided by the user 112 may be stored in the player information field 304 of the player information data structure 300 for the user 112. The information about the input may define preferences of the user 112 related to the presentation of an event, quality preferences, window layout preferences, timing of the input, and/or other information to track input provided by a user 112. In one embodiment, the input provided by the user 112 may not be stored and may just be used to manipulate in-state memory of the gaming device 108 to rearrange the various windows described herein.

In response to receiving the input, the method continues by ceasing rendering of the video of the event to the portion of the display screen 248 of the gaming device 108 (step 528). In some embodiments, ceasing the rendering of the video of the event may comprise preventing the display of the video to any portion of the display screen 248 and display area 400. In one embodiment, the video distribution server 116 may send a cease-rendering command (e.g., in response to receiving the input to alter the presentation of the event, that causes the video of the event to cease rendering to the first portion of the display screen 248 of the gaming device 108.

Next, the method continues by rendering an alternative presentation of the event to the display screen 248 of the gaming device 108 (step 532). In some embodiments, the video distribution server 116 may send an alternative rendering command that causes (e.g., play-by-play information associated with the event, etc.) the alternative presentation to be rendered, in real time, to a portion of the display screen 248. As provided above, the alternative presentation of the event may correspond to a non-video presentation of the event. Rather than rendering information about the event received from a video source 110A-D, the alternative presentation of the event corresponds to a description of a state of the event based on play-by-play information received, for example, from a wagering host server 144 and/or the event data server 156. The description of the state of the event may be rendered as a real-time output of text describing a state of the event over time and/or as an alternative 2D or 3D graphical presentation of the event comprising a simulation of the event other than video of the event.

Figure 6:
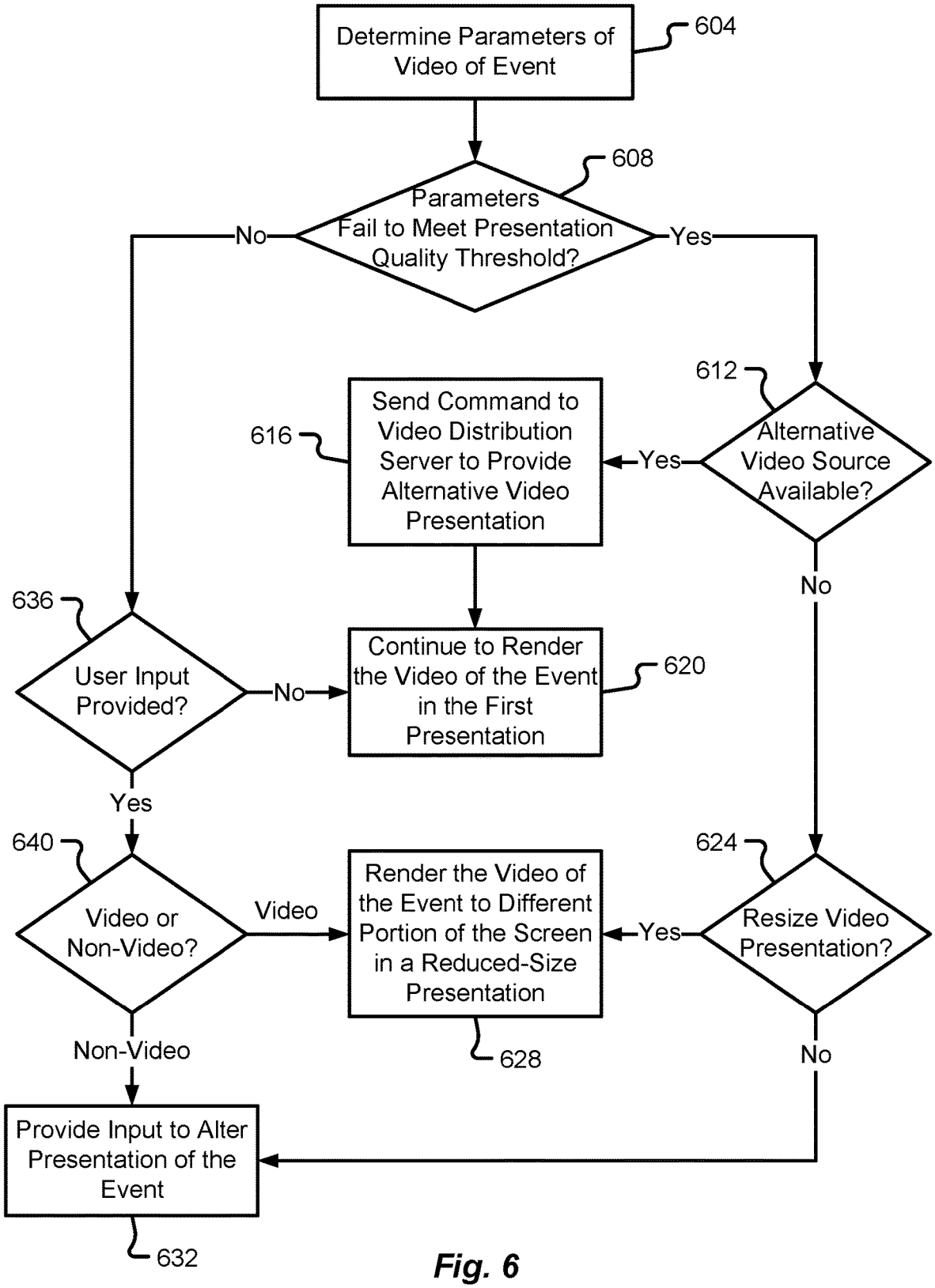
FIG. 6 is a flow diagram depicting a method of determining to alter a presentation of an event displayed by a gaming device in accordance with embodiments of the present disclosure.

FIG. 6 is a flow diagram depicting a method of altering a presentation of an event displayed by a gaming device 108 in accordance with embodiments of the present disclosure. In some embodiments, the method of FIG. 6 may correspond to a determination associated with the determination described in conjunction with step 516 of FIG. 5. The method begins by determining parameters of the video of the event rendered to the display screen 248 of the gaming device 108 (step 604). As the video is rendered to the display screen 248 in real time, the gaming device 108 and/or the video distribution server 116 may continuously, or at specific timed intervals, monitor the video signal of a primary video source for parameters such as display resolution, frame rate, reliability, and/or other quality parameters. In some embodiments, these parameters may be stored in a video channel information data structure 332.

Next, the method proceeds by determining whether the parameters of the video fail to meet the video presentation quality threshold value for a viewing configuration of the gaming device 108 (step 608). In some embodiments, the video presentation quality threshold value may be stored in a memory of the gaming device 108 and/or the video distribution server 116 (e.g., the video channel information data structure 332, etc.). The video presentation quality threshold value may correspond to a predetermined minimum acceptable value for one or more of the display resolution, frame rate, reliability, etc., of the video. In one embodiment, the video presentation quality threshold value may depend on a size or location of a window 404A, 404E, etc. to which the video is rendered to on the display area 400 of the display screen 248. For instance, a smaller size of window 404E may have a presentation quality threshold value defining a minimum acceptable display resolution of VGA, while a larger size of window 404A may have a presentation quality threshold value defining a minimum acceptable display resolution of HD 1080.

When the parameters are determined to fail to meet the presentation quality threshold value for the presentation of video in a viewing configuration of the gaming device 108, the method continues by determining whether an alternative video source is available (step 612). In some embodiments, an alternative video source may correspond to a video source 110A-N that is capable of providing video of the event on a different channel than the channel associated with the failing parameters. The alternative video source may be required to have similar, if not identical, parameters to the channel prior to having the failing parameters. When an alternative video source is available, the method may proceed by sending a command to the video distribution server 116 to provide the alternative video presentation to the gaming device 108 (step 616). In some embodiments, the gaming device 108 can just use an alternative URL or alternative method. For instance, the gaming device 108 may send the command if an URL, or method, is not available that meets the predetermined parameters required. In this case, the gaming device 108 may instruct, or query, the video distribution server 116 to make an URL, or method, available. In one embodiment, the gaming device 108 may not query for the alternative presentation and may instead subscribe to a stream of video streams to event mappings published by the video distribution server 116. The gaming device 108 can continue to render the video of the event in the first presentation (e.g., via the first presentation window 404A, etc.) using the alternative video source without significant interruption or degradation in quality (step 620).

When an alternative video source is not available, the method may proceed by determining whether the video presentation provided by the primary video source can be resized to suit the parameters of the primary video source (step 624). For instance, if the failed parameter is a VGA resolution for the larger first presentation window 404A, then the method may determine that resizing the window to the smaller size of window 404E may allow the parameters of video to fall within the minimum acceptable display resolution for presentation by the display screen 248. In some embodiments, the method may render the video of the event to a different portion of the display screen 248 in the reduced-size presentation (step 628). In one embodiment, the video distribution server 116 may send a command to the gaming device 108 to render the video of the event to the different portion of the display screen 248 in the reduced-size presentation. One example of this reduced-size presentation may be represented by the fifth presentation window 404E shown in FIG. 4F. If, the video presentation cannot be resized to place the video in an acceptable, or passing, presentation quality threshold value, the method may proceed by providing the input to alter the presentation of the event (step 632).

In some embodiments, the method may determine that the parameters of the video meet the presentation quality threshold value for the presentation of video in a viewing configuration of the gaming device 108 in step 608 and proceed by determining whether a user input was provided (step 636). In some cases, a user 112 may be dissatisfied with a particular video presentation and provide an input to change a setting for the display of the video. The user input may be associated with a request by a user 112 to resize the video presentation to a reduced-size video presentation. This type of input may be provided by the user 112 to allow another application (e.g., games, wagering interfaces, etc.) to be displayed to a larger portion (e.g., the primary window) of the display screen 248. In some embodiments, the user 112 may not wish to watch a video of the event and would prefer to have a play-by-play alternative presentation of the event. The method determines whether the input is a "video" input provided by the user 112, for example, selecting to resize the video presentation or a "non-video" input provided by the user 112, for example, selecting to view an alternative presentation of the event other than video (step 640). When the video input is provided by the user 112, the method may proceed by rendering the video of the event to a different portion of the display screen 248 in the reduced-size presentation (step 628). However, when the non-video input is provided by the user, the method may proceed by providing the input to alter the presentation of the event (step 632). After providing the input to alter the presentation of the event, the method may continue according to one or more steps of the method of FIG. 5, for example, after step 516.

Figure 7:
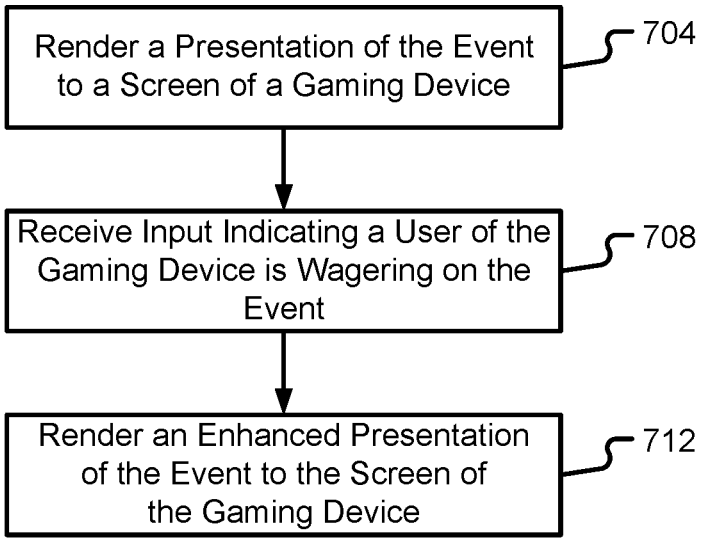
FIG. 7 is a flow diagram depicting a first method of determining an enhanced presentation of an event for display by a gaming device in accordance with embodiments of the present disclosure.
Figure 8:
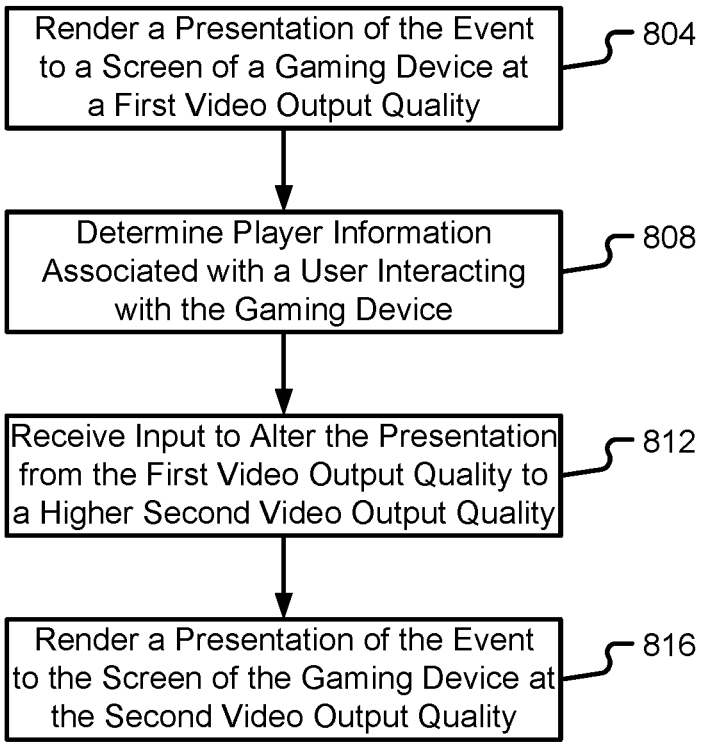
FIG. 8 is a flow diagram depicting a second method of determining an enhanced presentation of an event for display by a gaming device in accordance with embodiments of the present disclosure.

Referring now to FIGS. 7 and 8, flow diagrams depicting methods of determining an enhanced presentation of an event for display by a gaming device 108 are shown in accordance with embodiments of the present disclosure. FIG. 7 generally describes altering a presentation of an event rendered to a gaming device 108 in response to determining a user 112 has wagered on the event. The method of FIG. 7 may be represented as a transition from any of the alternative presentations of the event associated with the second, third, and fourth presentation windows 404B, 404C, 404D, shown in FIGS. 4C, 4D, 4E, 4F to the video presentation of the event associated with the first presentation window 404A shown in FIG. 4B. FIG. 8 generally describes altering a presentation of an event rendered to a gaming device 108 in response to determining a user 112 has earned an ability to change the presentation of events rendered to the gaming device 108. In some embodiments, the method of FIG. 8 may be represented as a transition from the fifth presentation window 404E shown in FIG. 4F to the first presentation window 404A shown in FIG. 4B.

In FIG. 7, the method begins by rendering a presentation of the event to a display screen 248 of a gaming device 108 (step 704). The presentation of the event may correspond to the non-video alternative presentation of the event as shown in the second presentation window 404B of FIG. 4C. In this presentation, play-by-play information about the state of the event may be received from the wagering host server 144 and rendered, in real time, to the display screen 248 in a text-based or non-video graphical representation output.

The method continues by receiving an input that user 112 of the gaming device 108 has wagered on the event (step 708). This information may be determined by the gaming device 108 in response to the user 112 placing a bet via the wagering interface window 412 of the display area 400. In some embodiments, the wagering session instruction set 232 may receive the bet placed by the user 112 and communicate information about the bet and/or the event to be used by the display presentation instruction set 228 and/or the video distribution server 116 in altering the presentation of the event.

In response to receiving the input that the user 112 has wagered on the event, the method continues by rendering an enhanced presentation of the event to the display screen 248 of the gaming device 108. The enhanced presentation of the event may correspond to a video presentation of the event. In some embodiments, when the non-video alternative presentation of the event is a text-based output, the enhanced presentation of the event rendered to the display screen 248 of the gaming device 108 may correspond to a 2D or 3D graphical output.

In FIG. 8, the method begins by rendering a video presentation of the event to a display screen 248 of a gaming device 108 at a first video output quality (step 804). The first video output quality may correspond to a low-resolution output having a display resolution of less than HD 720.

The method proceeds by determining player information associated with a user 112 interacting with the gaming device 108 (step 808). The interaction may include playing a game on the gaming device 108, placing a bet via the gaming device 108, watching a video on the gaming device 108, being detected (e.g., via the cameras 278, etc.) at or in proximity to the gaming device 108, and/or the like. The gaming device 108, in response to determining the user 112 is interacting with the gaming device 108, may refer to a player profile for the user 112 stored in a player profile database 148. In some embodiments, the player profile for the user 112 may include a player rank, paid-for access, wager history, and/or other information associated with a quality of video presentation available for the user 112.

Next, the method may proceed by receiving an input to alter the video presentation from the first video output quality to a higher second video output quality (step 812). The input may be provided automatically in response to determining the user 112 has access to a higher quality of video presentation available for the user 112. In one embodiment, the user 112 may select to alter the presentation to the higher second video output quality via interaction with the user interface 216 of the gaming device 108.

In response to receiving the input to alter the video presentation, the method continues by rendering a presentation of the event to the display screen 248 of the gaming device 108 at the second video output quality (step 816). The second video output quality may correspond to a high-resolution output having a display resolution of greater than, or equal to, HD 720, 2K, 4K, and/or the like.

A number of variations and modifications of the disclosure can be used. It would be possible to provide for some features of the disclosure without providing others. In some embodiments, live audio associated with the event may be maintained and/or simulated audio for the event may be presented by the gaming device 108. For example, live audio may be received from a "live audio only" stream via the one or more video sources 110. In one embodiment, the one or more video sources 110 may include audio sources. The audio for an event may be presented alone, or in combination with the text presentation (e.g., similar to the fourth presentation window 404D). Audio may be very low bandwidth and provide an increased level of engagement and excitement between a user 112 and the gaming device 108 when quality video is not available. Simulated audio may comprise thuds, swooshes, cheering, etc., and/or other sounds that may be synchronized to incidents in the live events. In one embodiment, if the video quality for a particular live video stream does not meet the required parameters and the user 112 is in the sportsbook, the gaming device 108 may determine from the video distribution server 116 that a live video stream of the event is being shown on one or more screens (e.g., a big screen, etc.) of the sportsbook. In this example, the gaming device 108 may cease showing the video and/or inform the user 112 to just look at a particular screen (e.g., the big screen) in the sportsbook. The user 112 may still use the gaming device 108 to place wagers and may even receive an alternative presentation of the event (e.g., a text-based, or other presentation) with the text idea. In some embodiments, the user 112 may be informed to use their mobile device to watch the live video of the event. For instance, a quick response (QR) code may be rendered to the display screen 248 that, when scanned by the mobile device, renders the live video on the mobile device. In one embodiment, the gaming device 108 may send the URL of the live video of the event to the mobile device wirelessly.

The live audio presentation may comprise audio from the video source of the event or it may comprise audio obtained from an alternative audio source, such as an AM broadcast covering the event. In some embodiments, the alternative audio source may be described differently by a set of sports broadcasters/hosts than the audio from the video source. In any event, the live audio presentation may be forwarded to the mobile device of the user 112. In this example the user 112 may be able to listen to the audio for the event using their headphones. In one embodiment, a full audio stream of the event may be rebroadcast over a wireless connection to the mobile device of the user 112 (e.g., via Bluetooth®, Bluetooth Low Energy, WiFi, etc.). Additionally or alternatively, an URL of the live audio broadcast associated with the event may be sent to the mobile device of the user 112 (e.g., via Bluetooth, Bluetooth Low Energy, a scan of an NFC tag, and/or the display and scan of a QR code, etc.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, an EGM as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the communication network includes a WAN, the gaming system includes a central server, central controller, or remote host and an EGM (or personal gaming device) each located in a different gaming establishment in a same geographic area, such as a same city or a same state. Gaming systems in which the communication network includes a WAN are substantially identical to gaming systems in which the communication network includes a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A gaming device, comprising:

a display device;

a communications interface;

a processor coupled to the display device and the communications interface; and a memory coupled with and readable by the processor and storing therein instructions that, when executed by the processor, cause the processor to:

receive, via the communications interface, video of an event from a video source;

receive, via the communications interface, play-by-play information associated with the event from a sports wagering host server;

render, in real time, the video of the event to a first portion of a screen of the display device in a first presentation of the event;

receive, based on a video quality characteristic of the video received from the video source falling below a predetermined quality threshold value for display stored in a computer memory device, an input to alter the first presentation of the event;

cease, in response to receiving the input to alter the first presentation of the event, rendering of the video of the event to the first portion of the screen of the display device; and render, in real time and in response to receiving the input to alter the first presentation of the event, the play-by-play information associated with the event to a portion of the screen in a second presentation of the event as an alternative to the first presentation of the event.

2. The gaming device of claim 1, wherein the play-by-play information is rendered to the first portion of the screen as a real-time output of text describing a state of the event over time.

3. The gaming device of claim 1, wherein the play-by-play information is rendered to the first portion of the screen as an alternative graphical presentation of the event comprising a computer-generated simulation of the event other than video of the event.

4. The gaming device of claim 1, wherein the instructions further cause the processor to:

receive input from a user interacting with the gaming device placing a bet on a particular outcome of the event; and send, via the communications interface, information describing the bet to the sports wagering host server on behalf of the user.

5. The gaming device of claim 1, wherein the video of the event is a live video stream, and the video quality characteristic comprises at least one of a display resolution, a frame rate, and a reliability of the live video stream, and the predetermined quality threshold value for display comprises a predetermined minimum acceptable value for at least one of the display resolution, the frame rate, and the reliability of the live video stream.

6. The gaming device of claim 1, wherein the input to alter the first presentation is received from a video management server in communication with the gaming device.

7. The gaming device of claim 1, wherein prior to rendering the video of the event, the instructions further cause the processor to:

determine whether a user interacting with the gaming device placed a bet on a particular outcome of the event; and select, only when the user placed the bet, the video source to render the video of the event from a plurality of video sources.

8. The gaming device of claim 1, wherein the instructions further cause the processor to:

receive an input to alter the second presentation of the event; and render, in real time, the video of the event to the first portion of the screen, wherein the video of the event is a live video stream.

9. The gaming device of claim 1, wherein the video quality characteristic of the video rendered to the first portion of the screen of the display device is based on a physical dimension of the first portion of the screen.

10. A method for providing an alternative presentation of an event on a gaming device, comprising:

receiving, via a communications interface of the gaming device, video of the event from a video source;

receiving, via the communications interface, play-by-play information associated with the event from a sports wagering host server;

rendering, in real time, the video of the event to a first portion of a screen of a display device of the gaming device in a first presentation;

receiving, based on a video quality characteristic of the video received from the video source falling below a predetermined quality threshold value for display stored in a computer memory device, an input to alter the first presentation of the event;

ceasing, in response to receiving the input to alter the first presentation of the event, the rendering of the video of the event to the first portion of the screen of the display device; and rendering, in real time and in response to receiving the input to alter the first presentation of the event, the play-by-play information associated with the event to a portion of the screen in a second presentation in lieu of the video.

11. The method of claim 10, wherein the play-by-play information is rendered to the first portion of the screen as a real-time output of text describing a state of the event over time.

12. The method of claim 10, wherein the play-by-play information is rendered to the first portion of the screen as an alternative graphical presentation of the event comprising a computer-generated simulation of the event other than video of the event.

13. The method of claim 10, further comprising:

receiving input from a user interacting with the gaming device comprising the user placing a bet on a particular outcome of the event; and sending, via the communications interface, information describing the bet to the sports wagering host server on behalf of the user.

14. The method of claim 10, wherein the video of the event is a live video stream, and the video quality characteristic comprises at least one of a display resolution, a frame rate, and a reliability of the live video stream, and the predetermined quality threshold value for display comprises a predetermined minimum acceptable value for at least one of the display resolution, the frame rate, and the reliability of the live video stream.

15. The method of claim 10, wherein prior to rendering the video of the event, the method comprises:

determining whether a user interacting with the gaming device placed a bet on a particular outcome of the event; and selecting, only when the user placed the bet, the video source to render the video of the event from a plurality of video sources.

16. A system for providing alternative presentations of an event for display, comprising:

a server, comprising:

a communications interface;

a processor coupled to the communications interface; and a memory coupled with and readable by the processor and storing therein instructions that, when executed by the processor, cause the processor to:

receive, via the communications interface, video of the event from a video management server;

receive, via the communications interface, play-by-play information associated with the event from a sports wagering host server;

send a first rendering command that causes the video of the event to be rendered, in real time, to a first portion of a screen of a display device in a first presentation of the event;

receive, based on a video quality characteristic of the video received from the video source falling below a predetermined quality threshold value for display stored in a computer memory device, an input to alter the first presentation of the event;

send a cease-rendering command, in response to receiving the input to alter the first presentation of the event, that causes the video of the event to cease rendering to the first portion of the screen of the display device; and send a second rendering command, in response to receiving the input to alter the first presentation of the event, that causes the play-by-play information associated with the event to be rendered, in real time, to a portion of the screen in a second presentation of the event as an alternative to the first presentation of the event.

17. The system of claim 16, wherein the server further comprises:

a first video connection to a first live video source, wherein the first live video source provides the video of the event at a first video output quality; and a second video connection to a second live video source, wherein the second live video source provides the video of the event at a different second video output quality.

18. The system of claim 17, wherein the input to alter the first presentation of the event is based on a signal received, via the communications interface, from the video management server, and wherein the signal indicates that at least one of a display resolution, a frame rate, and a reliability of the video associated with at least one of the first live video source and the second live video source is below a predetermined minimum acceptable value for at least one of the display resolution, the frame rate, and the reliability of the video that corresponds to the predetermined quality threshold value for display.

19. The system of claim 18, wherein the play-by-play information is caused to be rendered to the first portion of the screen as a real-time output of text describing a state of the event over time.

20. The system of claim 18, wherein the play-by-play information is caused to be rendered to the first portion of the screen as an alternative graphical presentation of the event comprising a computer-generated simulation of the event other than video of the event.

* * * * *